US007832845B2

(12) United States Patent
Mita

(10) Patent No.: US 7,832,845 B2
(45) Date of Patent: Nov. 16, 2010

(54) LIQUID EJECTION HEAD, IMAGE FORMING APPARATUS AND METHOD OF MANUFACTURING LIQUID EJECTION HEAD

(75) Inventor: Tsuyoshi Mita, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 890 days.

(21) Appl. No.: 11/730,098

(22) Filed: Mar. 29, 2007

(65) Prior Publication Data

US 2007/0229605 A1 Oct. 4, 2007

(30) Foreign Application Priority Data

Mar. 31, 2006 (JP) ..... 2006-100296

(51) Int. Cl.
*B41J 2/045* (2006.01)

(52) U.S. Cl. ..... 347/68

(58) Field of Classification Search ..... 347/68, 347/70–72

See application file for complete search history.

(56) References Cited

U.S. PATENT DOCUMENTS

| | | | |
|---|---|---|---|
| 6,666,547 | B1 | 12/2003 | Takahashi et al. |
| 2005/0168524 | A1 | 8/2005 | Xin-Shan et al. |

FOREIGN PATENT DOCUMENTS

| | | | |
|---|---|---|---|
| EP | 1024001 | A2 | 8/2000 |
| EP | 1038675 | A2 | 9/2000 |
| JP | 4-312852 | A | 11/1992 |
| JP | 2004-209874 | A | 7/2004 |

*Primary Examiner*—An H Do
(74) *Attorney, Agent, or Firm*—Birch, Stewart, Kolasch & Birch, LLP

(57) ABSTRACT

The liquid ejection head includes: a substrate made of a prescribed material on which a thin film is deposited to constitute a diaphragm; a piezoelectric body which is formed on a face of the diaphragm reverse to a face adjacent to the substrate; and a pressure chamber which is formed on the substrate by etching in a plurality of steps from a side reverse to a side adjacent to the diaphragm and has a difference in width thereof.

15 Claims, 16 Drawing Sheets

LIQUID EJECTION HEAD, IMAGE FORMING APPARATUS AND METHOD OF MANUFACTURING LIQUID EJECTION HEAD

BACKGROUND OF THE INVENTION

1. Field of the Invention

The present invention relates to a liquid ejection head, an image forming apparatus and a method of manufacturing a liquid ejection head, and more particularly, to a liquid ejection head, an image forming apparatus and a method of manufacturing the liquid ejection head, which liquid ejection head has excellent ejection performance, as well as being suitable for mass production and cost reduction.

2. Description of the Related Art

There are commonly used liquid ejection heads which include nozzles, pressure chambers connected to the nozzles, and actuators that change the pressure inside the pressure chambers, liquid being ejected from the corresponding nozzle when a drive signal is applied to the actuator. In liquid ejection heads which use piezoelectric actuators as actuators, in general, a piezoelectric body and an electrode are formed on a diaphragm that constitutes one side wall of each pressure chamber, and the pressure of the pressure chamber is changed through the diaphragm.

In these liquid ejection heads, similarly to when manufacturing semiconductor devices, a circular disk-shaped wafer made of monocrystalline silicon (silicon substrate) is prepared, and a diaphragm, piezoelectric bodies and electrodes are formed on this silicon substrate.

For example, Japanese Patent Application Publication No. 4-312852 discloses a head in which a diaphragm made of a silica film is formed on the surface of the silicon substrate by means of a thermal oxidation process.

Japanese Patent Application Publication No. 2004-209874 discloses a head in which a diaphragm made of pyrex glass is bonded to a silicon substrate, and the diaphragm is etched from the pressure chamber side to form smooth, edge-free recess sections in the diaphragm.

If liquid ejection heads are manufactured by using a circular disk-shaped wafer made of monocrystalline silicon (silicon substrate), then the number of liquid ejection heads that can be manufactured from one wafer is limited by the surface area of the disk-shaped wafer, and hence there are limitations on the mass production of liquid ejection heads and the reductions that can be achieved in the related manufacturing costs. In this respect, if it were possible to increase the surface area of the base material, for instance, by using a substrate material that can be supplied in the form of a roll, then this would be beneficial from the viewpoint of achieving mass production of liquid ejection heads and reducing manufacturing costs.

On the other hand, there have also been demands to arrange nozzles at high density. With increase in the nozzle density, it is necessary to reduce the size of the pressure chambers and to reduce the thickness of the film forming the diaphragm, but at the same time, any decline in the ejection performance must be prevented. For example, when it is sought to form an image on an ejection receiving medium by ejecting ink from a liquid ejection head, then even if the image resolution can be raised by increasing the density of the nozzles, for example, if ejection is not performed correctly, or if there are variations in ejection between different nozzles, then the quality of the image is decline. Moreover, if the ejection efficiency per nozzle is poor, then the liquid ejection head as a whole consumes a large amount of energy corresponding to the number of nozzles. Furthermore, if the production yield is poor, then it is not possible to reduce manufacturing costs.

In a bending type of actuator that uses a bimorph element, the characteristics of the diaphragm govern the characteristics of the actuator, and it is necessary to achieve a thinner diaphragm (having a thickness of 10 μm or less, for example), especially if the density of the nozzles is increased.

SUMMARY OF THE INVENTION

If it is sought to manufacture a liquid ejection head by rolling and etching of a stainless steel member, which has iron as a main component, then a problem arises in that if the thickness of the stainless steel member is reduced to 10 μm or less, in general, it becomes difficult to avoid the occurrence of pinholes. Pinholes occur in stainless steel as a result of the loss of particles of inclusion material other than iron, which is usually contained in the stainless steel, during the rolling process, or as a result of the presence of dirt. The occurrence of pinholes increases dramatically as a stainless steel member is reduced in thickness by rolling, and it is not possible to achieve thicknesses of 10 μm or below. It is difficult to provide 100% prevention against pinholes, and pinholes can be prevented by depositing a thin film in a clean room environment. By creating a diaphragm by film deposition, it is possible to resolve the problem of pinholes in rolling of stainless steel, and hence a thin diaphragm can be achieved.

The present invention has been contrived in view of the foregoing circumstances, an object thereof being to provide a liquid ejection head that has excellent ejection characteristics and is also suited to mass production and cost reduction, and a method of manufacturing such a liquid ejection head.

In order to attain the aforementioned object, the present invention is directed to a liquid ejection head, comprising: a substrate made of a prescribed material on which a thin film is deposited to constitute a diaphragm; a piezoelectric body which is formed on a face of the diaphragm reverse to a face adjacent to the substrate; and a pressure chamber which is formed on the substrate by etching in a plurality of steps from a side reverse to a side adjacent to the diaphragm and has a difference in width thereof.

Preferably, the material of the substrate is a stainless steel material containing iron as a main component.

Here, when it is stated that "iron is the main component", then this means that the total of the alloy elements other than iron is less than 50 wt %, in other words, the iron content exceeds 50 wt %. Stainless steels is a ferrous alloy containing chromium in the range of 12 wt % to 32 wt %, and forms a passivation layer keeping not to stain.

Preferably, the thin film constituting the diaphragm has a thickness of 1 μm to 10 μm.

According to the present invention, since the thin film is deposited on the substrate to form the diaphragm and the substrate is etched in the plurality of steps from the side reverse to the side adjacent to the diaphragm, in order to form the pressure chamber which has the difference in width thereof, then even if the diaphragm is deposited thinly to the thickness of 10 μm or less, and the substrate is only etched from one side (the pressure chamber side), it is still possible to improve the etching accuracy at the boundary between the substrate and the diaphragm (in other words, the positional accuracy of the edges of the ceiling face of the pressure chamber). Consequently, even if stainless steel is used as the material of the substrate, it is possible to provide the liquid ejection head that has the improved ejection efficiency by means of the diaphragm formed as the thin film, as well as reduced variations in ejection between different nozzles.

The piezoelectric material used is a material containing lead zirconate titanate (PZT) as a main component, such as PMN-PT-PZ, PNN-PT-PZ, and the like. The material used for the substrate is a ferritic stainless steel, such as AISI430, AISI405 (X6Cr17, X6CrAl13), or the like; or a martensitic stainless steel, such as AISI403, AISI410, AISI420 (X5Cr13, X10Cr13, X20Cr13), or the like, which has the coefficient of linear expansion close to that of PZT.

For example, the coefficient of linear expansion of AISI430 (X6Cr17) is $10.5\times10^{-6}$/° C., which is closer to the coefficient of linear expansion of PZT (8 to $11\times10^{-6}$/° C.) than the coefficient of linear expansion of silicon (Si) ($2.8\times10^{-6}$/° C.). By using the stainless steel material of this kind, it is possible to prevent deformation of the liquid ejection head due to the occurrence of warping, or the like.

Furthermore, the diaphragm is constituted by an oxide film, such as $SiO_2$, $Al_2O_3$, or the like, or by a nitride film, such as TiN, TiAlN, TiCrAlN, SiCN, or the like.

As stated above, the stainless steel is used as the material of the substrate, and it is not used for the diaphragm, which needs to be formed thinly. Even if the thickness of the substrate made of the stainless steel is 100 μm to 500 μm, satisfactory etching accuracy is achieved at the boundary between the substrate and the diaphragm by adopting the multiple-step etching as described above, and therefore it is possible to prevent the occurrence of pinholes, while improving ejection performance.

Moreover, by using wet etching in the multiple-step etching process, it is possible to manufacture the liquid ejection head more inexpensively than in a case where dry etching is used.

Preferably, the diaphragm and the piezoelectric body are made of a same material.

According to this aspect of the present invention, since the Young's modulus of the diaphragm is the same as the Young's modulus of the piezoelectric bodies, then ejection efficiency is improved. Furthermore, since the coefficient of linear expansion of the diaphragm is the same as the coefficient of linear expansion of the piezoelectric bodies, then the occurrence of warping is prevented.

Preferably, the piezoelectric body is made of a piezoelectric material containing lead zirconate titanate as a main component; and the diaphragm is made of a material containing zirconia as a main component.

Here, where it is stated "containing lead zirconate titanate as a main component", then this means that the content of PZT (lead zirconate titanate) exceeds 50 wt %.

According to this aspect of the present invention, since the coefficient of linear expansion of the diaphragm made of the material containing zirconia as the main component (e.g., yttria stabilized zirconia (YSZ)) is close to the coefficient of linear expansion of the piezoelectric bodies containing PZT as the main component, then the occurrence of warping is prevented.

Preferably, an oxide film created by oxidation of a component in the substrate is formed on a surface of the substrate adjacent to the diaphragm.

According to this aspect of the present invention, when carrying out annealing (heat treatment) of the piezoelectric body, it is possible readily to prevent the components (such as iron) in the substrate from diffusing into the piezoelectric body.

In order to attain the aforementioned object, the present invention is also directed to an image forming apparatus, comprising: the above-described liquid ejection head, wherein the liquid ejection head ejects ink toward a prescribed medium to form an image on the medium.

In order to attain the aforementioned object, the present invention is also directed to a method of manufacturing a liquid ejection head, comprising: a diaphragm forming step of depositing a thin film to form a diaphragm, on a substrate made of a prescribed material; a piezoelectric body forming step of forming a piezoelectric body on a side of the diaphragm reverse to a side adjacent to the substrate; and a pressure chamber forming step of forming a pressure chamber having a difference in width thereof by etching the substrate in a plurality of steps, from a side of the substrate reverse to a side adjacent to the diaphragm.

Preferably, the diaphragm and the piezoelectric body are made of a same material; and the diaphragm forming step and the piezoelectric body forming step employ an aerosol deposition process.

According to this aspect of the present invention, it is possible to achieve a continuous process using the aerosol deposition process, which has a high film deposition rate, and therefore it is easy to carry out film deposition that is suited to increased surface area of the substrate.

According to the present invention, it is possible to provide a liquid ejection heads which is suited to mass production and cost reduction, as well as having excellent ejection characteristics, and to provide a method of manufacturing such a liquid ejection head.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
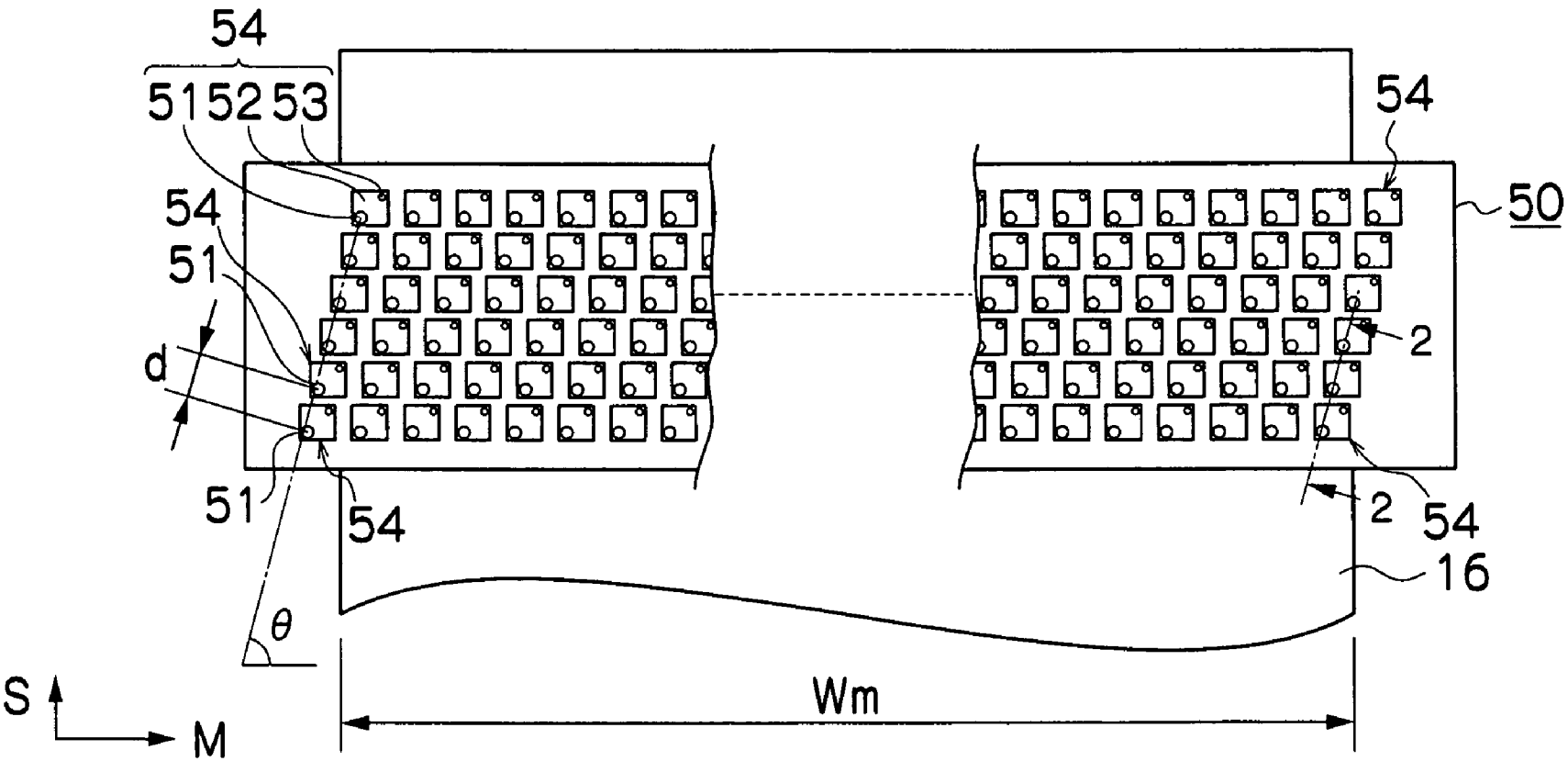
FIG. 1 is a plan perspective diagram showing the structure of a liquid ejection head according to an embodiment of the present invention.

FIG. 1 is a plan view perspective diagram showing the basic structure of a liquid ejection head 50 according to an embodiment of the present invention.

The liquid ejection head 50 shown as in FIG. 1 is a so-called full line head, having a structure in which a plurality of nozzles 51 (liquid ejection ports) which eject liquid toward a recording medium 16, such as paper, are arranged in a two-dimensional configuration through a length corresponding to the width Wm of the recording medium 16 in the direction perpendicular to the direction of conveyance of the recording medium 16 (the sub-scanning direction indicated by arrow S in FIG. 1), in other words, in the main scanning direction indicated by arrow M in FIG. 1 (this length is equivalent to the maximum recordable width).

The liquid ejection head 50 includes a plurality of pressure chamber units 54, each having the nozzle 51, a pressure chamber 52 connected to the nozzle 51, and a liquid supply port 53, the pressure chamber units 54 being arranged in two directions, namely, the main scanning direction M and an oblique direction forming a prescribed acute angle θ (where $0°<\theta<90°$) with respect to the main scanning direction M. In FIG. 1, in order to simplify the drawing, only a portion of the pressure chamber units 54 are depicted in the drawing.

More specifically, the nozzles 51 are arranged at a uniform pitch d in the direction forming the prescribed acute angle of θ with respect to the main scanning direction M, and hence the nozzle arrangement can be treated as equivalent to a configuration in which the nozzles are arranged at an interval of $d \times \cos\theta$ in a straight line following the main scanning direction M. By using the liquid ejection head 50, it is possible to form images on a recording medium 16 in one scanning action.

FIG. 1 shows the embodiment where the plurality of nozzles 51 are arranged two-dimensionally in order to achieve a structure whereby a high-resolution image can be formed at high-speed onto the recording medium 16, but the liquid ejection head according to the present invention is not limited in particular to the structure in which a plurality of nozzles 51 are arranged two-dimensionally, and it may also adopt a structure where a plurality of nozzles 51 are arranged one-dimensionally.

Below, various embodiments of the liquid ejection head 50 are described in detail.

First Embodiment

Figure 2:
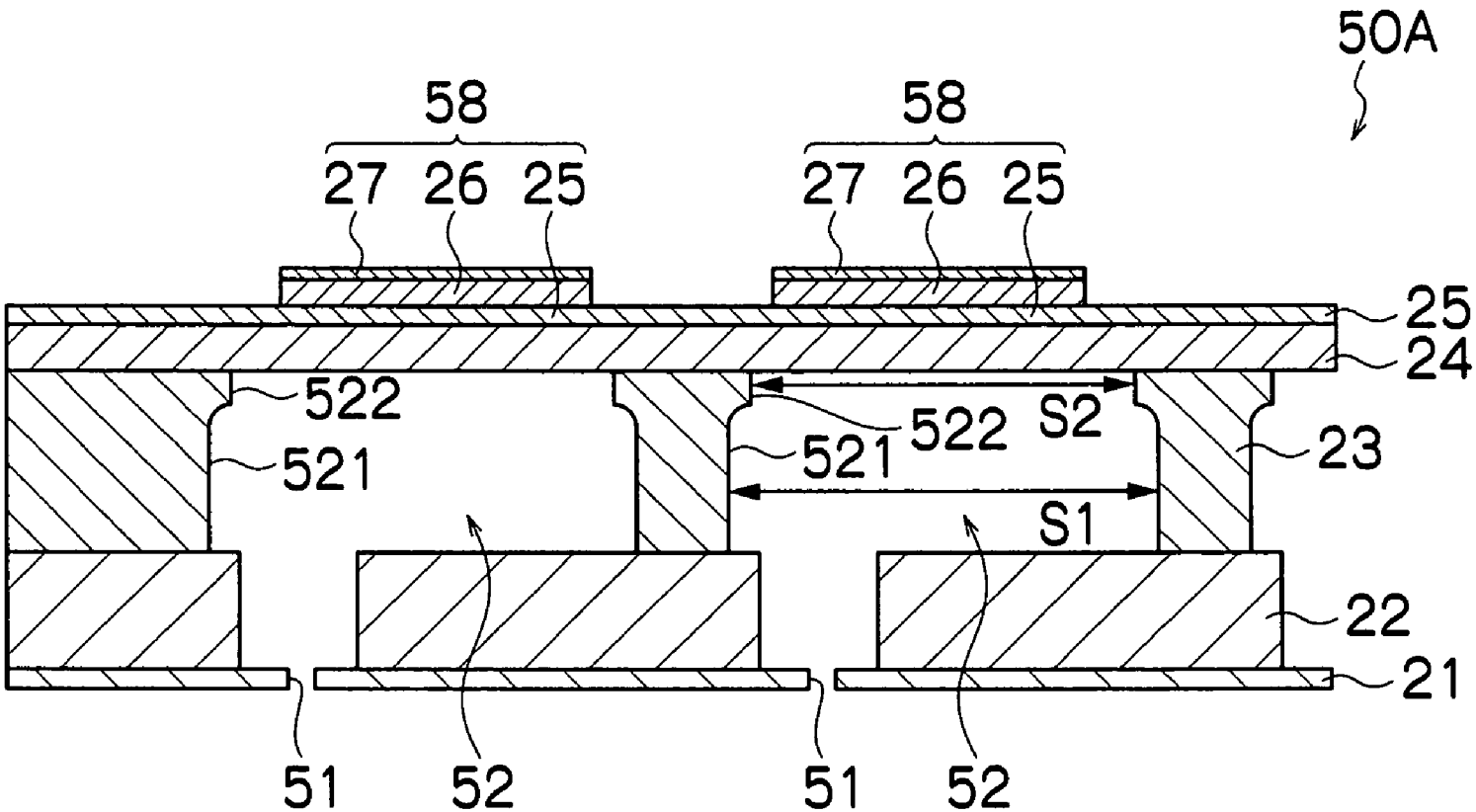
FIG. 2 is a cross-sectional diagram of a liquid ejection head according to a first embodiment of the present invention.

FIG. 2 is a cross-sectional diagram showing a liquid ejection head 50A according to a first embodiment of the present invention, and it corresponds a cross-section along line 2-2 in FIG. 1.

In FIG. 2, the liquid ejection head 50A is laminated from: a nozzle plate 21, which is formed with the nozzles 51; a nozzle connection plate 22, which is formed with apertures connecting the pressure chambers 52 to the nozzles 51; a pressure chamber forming plate 23, which is formed with the pressure chambers 52; and a diaphragm 24, which constitutes the upper wall faces of the respective pressure chambers 52. Moreover, the actuators 58 are formed on the diaphragm 24.

The pressure chamber forming plate 23 is made of stainless steel material. The stainless steel material is an alloy that contains iron (Fe) as the main component, and also contains chromium (Cr). Below, the pressure chamber forming plate 23 is referred to as the "stainless steel substrate" 23.

Stated alternatively, the liquid ejection head 50A in FIG. 2 is formed by: depositing the diaphragm 24 as a thin film onto the stainless steel substrate 23; forming the actuators 58, each of which includes a piezoelectric body 26 and electrodes 25 and 27, onto the face of the diaphragm 24 reverse to the face adjacent to the stainless steel substrate 23; forming the pressure chambers 52, each of which has a difference in width thereof, into the stainless steel substrate 23 by wet etching in a plurality of steps from the face of the stainless steel substrate 23 reverse to the face adjacent to the diaphragm 24; and bonding the nozzle connection plate 22 and the nozzle plate 21 onto the stainless steel substrate 23.

The cross-sectional area S1 of the opening of a lower portion 521 (the portion on the side facing to of the nozzle 51) of the pressure chamber 52 formed by the wet etching of the first step is larger than the cross-sectional area S2 of the opening of an upper portion 522 (the portion on the side adjacent to the diaphragm 24) of the pressure chamber 52 formed by the wet etching of the second step (the final step). Moreover, the depth of the wet etching of the first step, which depth corresponds the height of the lower portion 521 of the pressure chamber 52, is greater than the depth of the wet etching of the second step (the final step), which depth corresponds the height of the upper portion 522 of the pressure chamber 52.

In the present embodiment, the diaphragm 24 is made of a diffusion inhibiting material that prevents diffusion of iron, chromium, or the like, contained in the stainless steel substrate 23, into the piezoelectric bodies 26, during annealing of the piezoelectric bodies 26 as described below. More specifically, the diaphragm 24 is constituted by a film of an oxide, such as silica ($SiO_2$), alumina ($Al_2O_3$), or the like. Here, the diffusion speeds of iron and chromium in the oxide film constituting the diaphragm 24 are slower than the diffusion speeds of iron and chromium in the stainless steel substrate 23.

The actuators 58 are each constituted by disposing the piezoelectric body 26 between two electrodes (i.e., the upper electrode 25 and the lower electrode 27). The piezoelectric body 26 is made of lead zirconate titanate ($Pb(Zr,Ti)O_3$, (PZT)). The embodiment is described below in which PZT is used as the material of the piezoelectric body 26, but the material of the piezoelectric body 26 in the present invention is not limited in particular to PZT. It is also possible that the piezoelectric body 26 is made of a piezoelectric material containing PZT as the main component. Examples of the piezoelectric material containing PZT as the main component include: $PbMgNbO_3$—$PbTiO_3$—$PbZrO_3$ (PMN-PT-PZ), and $Pb(Ni_{1/3}Nb_{2/3})O_3$—$PbTiO_3$—$PbZrO_3$ (PNN-PT-PZ).

The lower electrode 25 is earthed, and is the common electrode that serves the plurality of actuators 58. On the other hand, the upper electrode 27 is an individual electrode provided for each actuator 58. When a prescribed drive signal is applied independently to the upper electrode 27, in other words, when a prescribed drive voltage is applied independently between the two electrodes 25 and 27, then the piezoelectric body 26 situated between the two electrodes 25 and 27 is displaced (deformed), the pressure inside the pressure chamber 52 is changed through the diaphragm 24, and the liquid in the pressure chamber 52 is ejected from the nozzle 51.

The manufacturing process for the liquid ejection head 50A according to the first embodiment shown in FIG. 2 is now described with reference to FIGS. 3A to 3P.

Figure 3A:
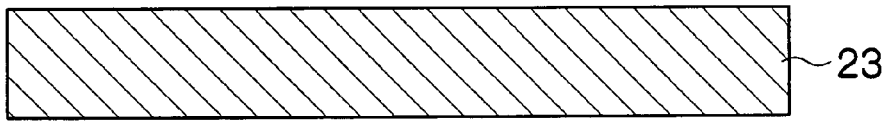
FIGS. 3A to 3P are processing step diagrams for explaining the manufacturing process for the liquid ejection head according to the first embodiment.

Firstly, a stainless steel member containing iron as the main component and also containing chromium is prepared as the substrate 23 as shown in FIG. 3A. Here, "an alloy contains iron as the main component" means that the total of the elements other than iron is not more than 50 wt % in the alloy, in other words, the alloy contains iron of more than 50 wt %.

In the present embodiment, the stainless steel material that has the coefficient of linear expansion close to that of PZT used as the material for the piezoelectric bodies 26, and also has heat resistance with respect to the subsequent heat treatment process (the annealing process for calcining the piezoelectric bodies 26), is selected to be used as the substrate 23.

Specific examples of such the stainless steel material include: ferritic stainless steels, such as AISI430, AISI405 (X6Cr17, X6CrAl13), and the like; and martensitic stainless steels, such as AISI403, AISI410, AISI420 (X5Cr13, X10Cr13, X20Cr13), and the like.

The thickness of the stainless steel substrate 23 is, for example, 100 μm to 500 μm. If the plate material is thicker than the target thickness, then it is reduced in thickness by grinding (or by wet etching), so as to assume a thickness within the target range.

Figure 3B:
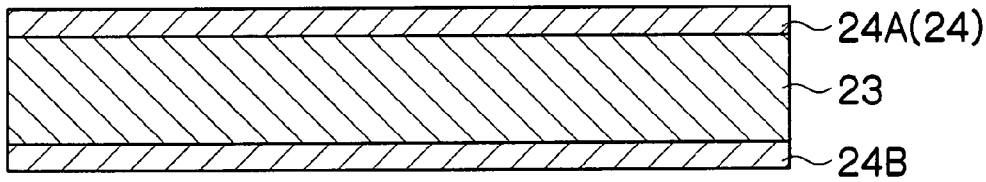

Thereupon, an metal oxide thin film 24A having a diffusion inhibiting effect with respect to the material contained in the stainless steel substrate 23 (in particular iron, the main component) is deposited onto the stainless steel substrate 23 as shown in FIG. 3B, in order to form the diaphragm 24 in FIG. 2. In the present embodiment, at the same time as depositing the oxide film 24A to form the diaphragm 24 on one surface of the stainless steel substrate 23, an oxide film 24B is also deposited simultaneously on the other surface of the stainless steel substrate 23. However, it is also possible to deposit only the oxide film 24A required for the diaphragm 24.

Here, possible examples of the material of the oxide film 24A include $SiO_2$, $Al_2O_3$, and the like.

The thickness of the oxide film 24A thus deposited is not smaller than 1 μm and not greater than 10 μm. Provided that the oxide film 24A has the thickness within this range, then diffusion of iron, chromium, or the like, contained in the stainless steel substrate 23, into the piezoelectric bodies 26, is sufficiently prevented during the annealing of the piezoelectric bodies 26, which annealing is described below, and furthermore, a sufficient amount of displacement of the oxide film 24A serving as the diaphragm 24 can be obtained. Therefore, the thickness within this range is desirable.

Examples of the thin film formation technique used to deposit the oxide film 24A include: physical vapor deposition (PVD) methods, such as sputtering and ion plating; a chemical vapor deposition (CVD) method; and liquid-phase deposition methods, such as a sol-gel method.

For example, the oxide films 24A and 24B are deposited on both faces of the stainless steel substrate 23 by a sputtering method, and the unwanted oxide film 24B is then removed in a subsequent processing step.

Figure 3C:
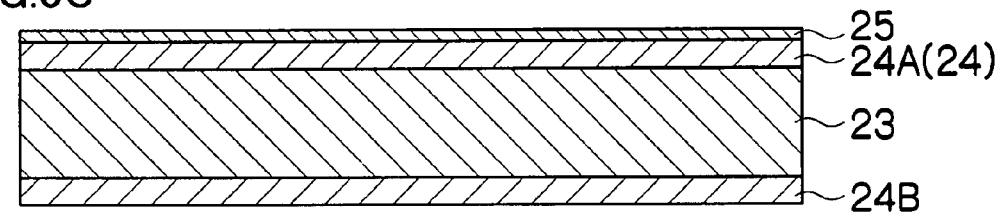

Next, a film made of Ti/Pt, Ti/Ir, Ti/Au, or the like, is deposited onto the oxide film 24A, which is used as the diaphragm 24, to form the lower electrode 25, as shown in FIG. 3C.

Figure 3D:
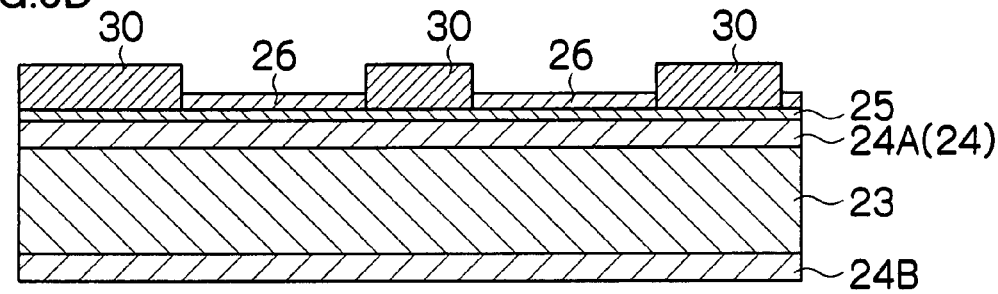

Thereupon, a resist 30 for forming the piezoelectric bodies 26 is applied onto the lower electrode 25, and films to form the piezoelectric bodies 26 are then selectively deposited as shown in FIG. 3D by means of an aerosol deposition (AD) process at normal temperature.

In the aerosol deposition process, the piezoelectric films are deposited by placing the stainless steel substrate 23 in a prescribed chamber and then blowing aerosol including submicron particles of the piezoelectric material borne in nitrogen gas, or the like, from a prescribed aerosol nozzle, onto the stainless steel substrate 23, while moving the stainless steel substrate 23 and the aerosol nozzle relatively to each other.

Figure 3E:
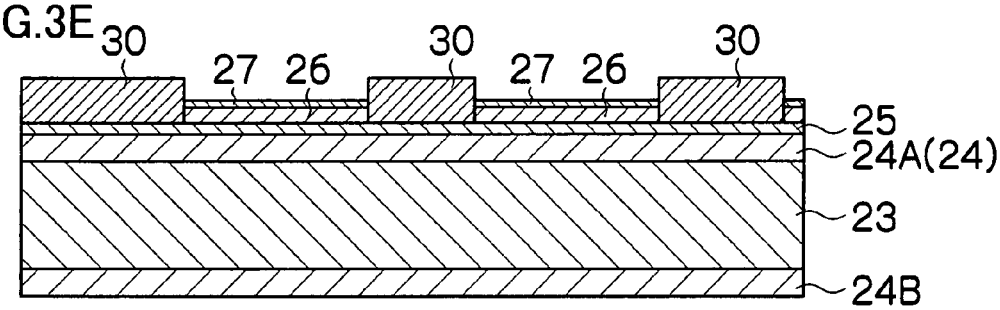

Next, films made of Ti/Pt, Ti/Ir, Ti/Pt/Au, or the like, are deposited onto the piezoelectric bodies 26 to form the upper electrodes 27, as shown in FIG. 3E.

Figure 3F:
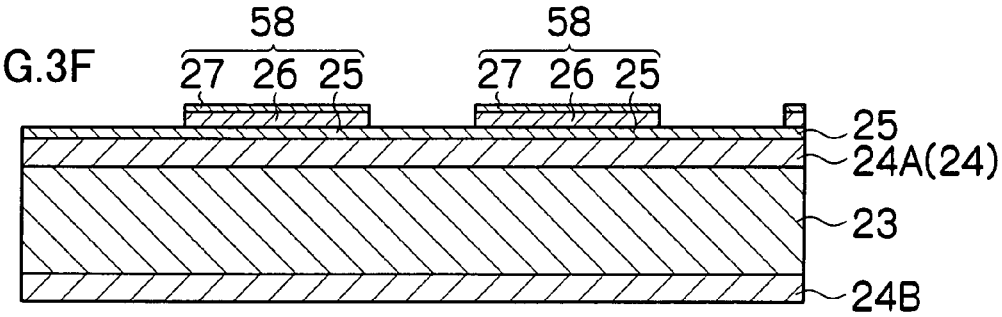

Thereupon, the resist 30 for forming the piezoelectric bodies 26 is removed as shown in FIG. 3F, and then the stainless steel substrate 23 formed with the piezoelectric bodies 26 is subjected to annealing (heat treatment) at a temperature of 700° C. or above (for example, 800° C.).

Thus, the actuators 58 including the lower electrode 25, the piezoelectric bodies 26 and the upper electrodes 27 are formed on the oxide film 24A, which constitutes the diaphragm 24.

Figure 3G:
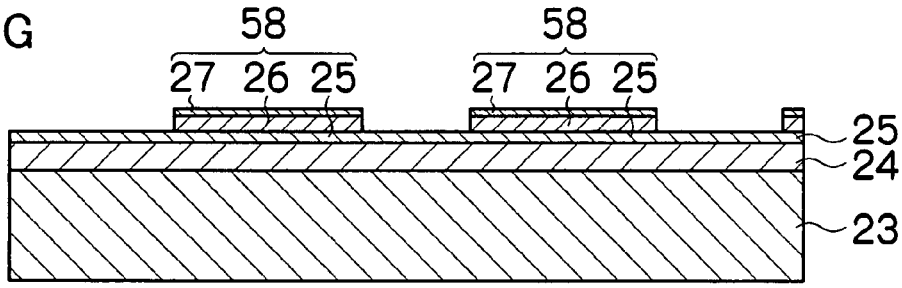

If the oxide films 24A and 25B have been deposited on both faces of the stainless steel substrate 23, then the structure shown in FIG. 3G is obtained by removing the unnecessary oxide film 24B by means of grinding or wet etching.

Figure 3H:
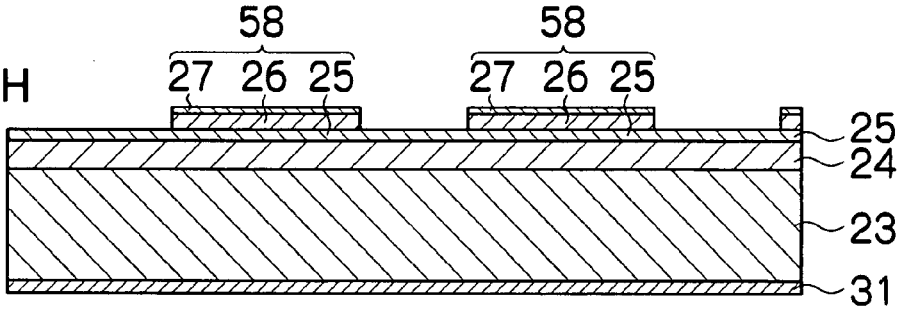
Figure 3I:
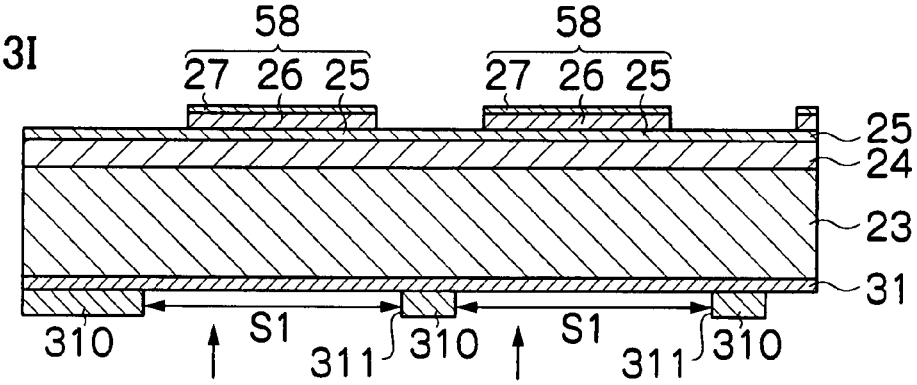
Figure 3J:
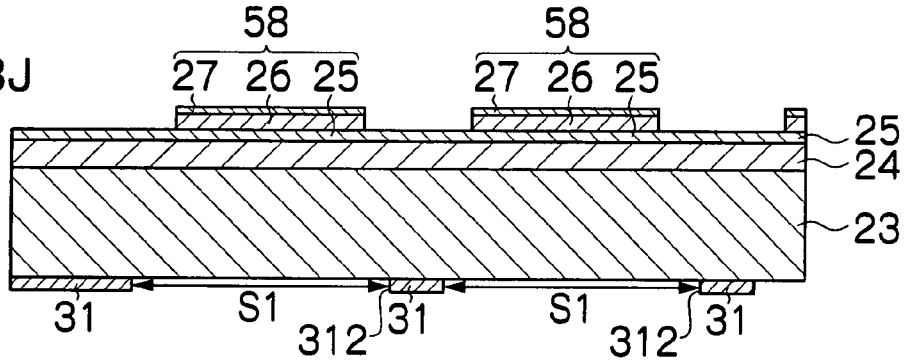
Figure 3K:
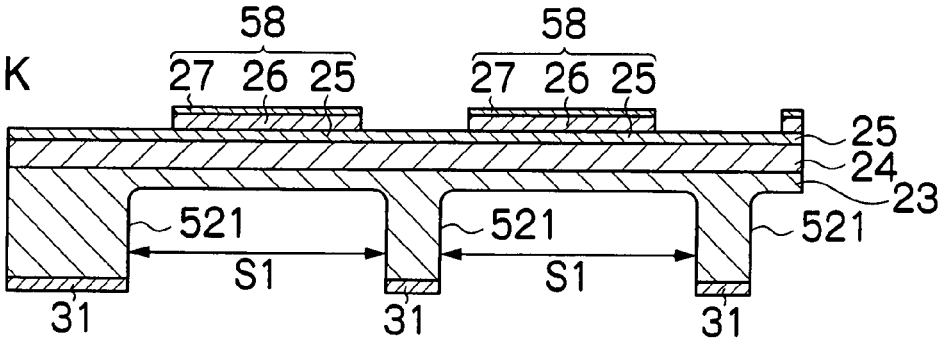

Thereupon, a dry film resist 31 is applied onto the side of the stainless steel substrate 23 in which the pressure chambers are to be formed (in other words, onto the face reverse to the face on which the diaphragm 24 has been formed) as shown in FIG. 3H. Then, a first mask 310 having opening sections 311 corresponding to the cross-sectional areas S1 of the lower steps of the pressure chambers 52 in FIG. 2, is formed on the dry film resist 31, and exposure and development are carried out using the first mask 310 as shown in FIG. 3I. Thereby, opening sections 312 corresponding to the cross-sectional areas S1 of the lower steps of the pressure chambers 52 in FIG. 2, are formed in the dry film resist 31 as shown in FIG. 3J. Thereupon, the stainless steel substrate 23 is subjected to wet etching of the first step, from the side where the pressure chambers are to be formed, and the first recess sections 521 having the opening cross-sectional areas of S1, each of which constitutes a portion of each pressure chamber 52 in FIG. 2, are formed in the stainless steel substrate 23 as shown in FIG. 3K.

Figure 3L:
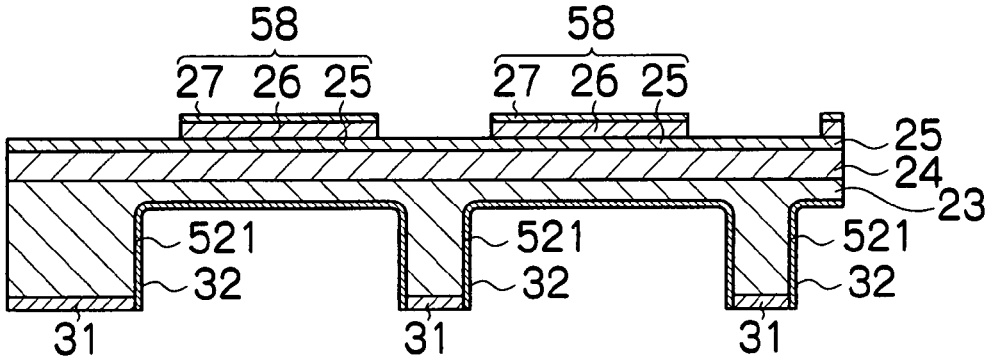
Figure 3M:
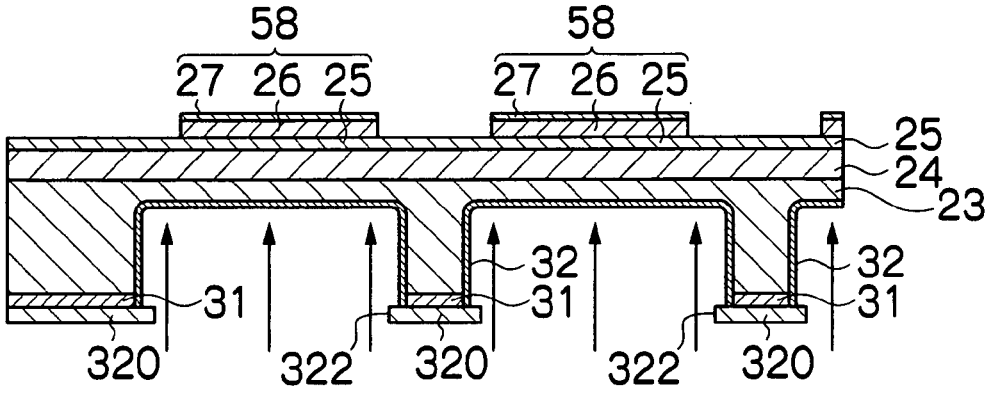
Figure 3N:
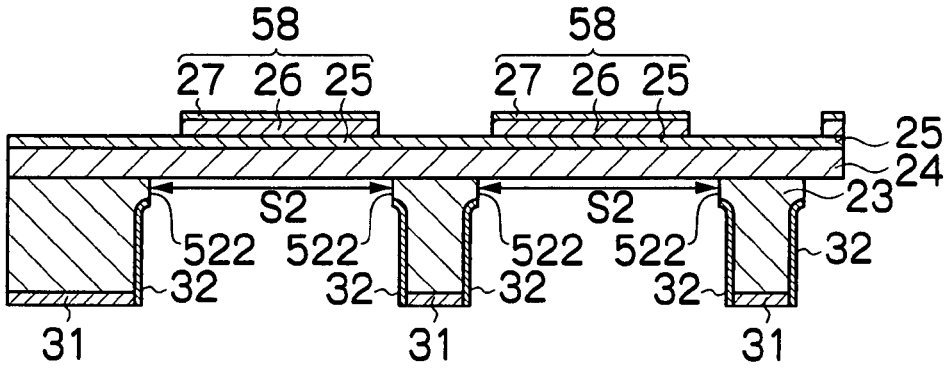

Thereupon, a liquid resist 32, such as an electrodeposited resist, is applied onto the recess sections 521 in the stainless steel substrate 23 as shown in FIG. 3L. Then, exposure and development are carried out as shown in FIG. 3M using a second mask 320 having opening sections 322 corresponding to the cross-sectional areas S2 of the upper steps of the pressure chambers 52 in FIG. 2, which have the opening cross-sectional areas smaller than the opening sections 311 of the first mask 310. Thereupon, the stainless steel substrate 23 is subjected to wet etching of the second step, in which the diaphragm 24 made of the oxide film serves as an etching stop layer, and thereby the second recess sections 522 having the opening cross-sectional areas S2, each of which constitutes a portion of each pressure chamber 52 in FIG. 2, are formed in the stainless steel substrate 23 as shown in FIG. 3N.

Here, the electrodeposited resist means a resist that is deposited by electroplating. In order to carry out etching of a complicated three-dimensional shape, if the substrate is conductive, then it is possible to form a uniform resist coating over the whole surface of the three-dimensional shape. Since even the parts that are difficult to cover, such as corner sections, can be coated with the resist, then this method is suitable for carrying out high-definition etching.

Figure 3O:
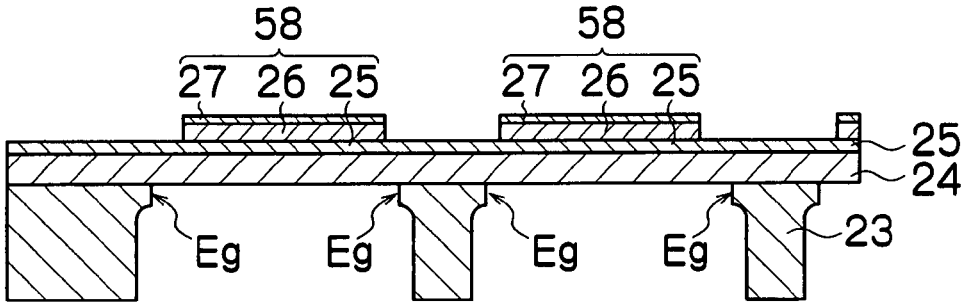

By carrying out the two-step etching as described above, it is possible to improve the etching accuracy at the boundary between the stainless steel substrate 23 and the diaphragm 24, in other words, to improve the positional accuracy of the edges of the ceilings of the pressure chambers 52, which edges are denoted with reference symbol Eg in FIG. 3O.

The resist (the dry film resist 31 and the electrodeposited resist 32) is removed as shown in FIG. 3O.

Figure 3P:
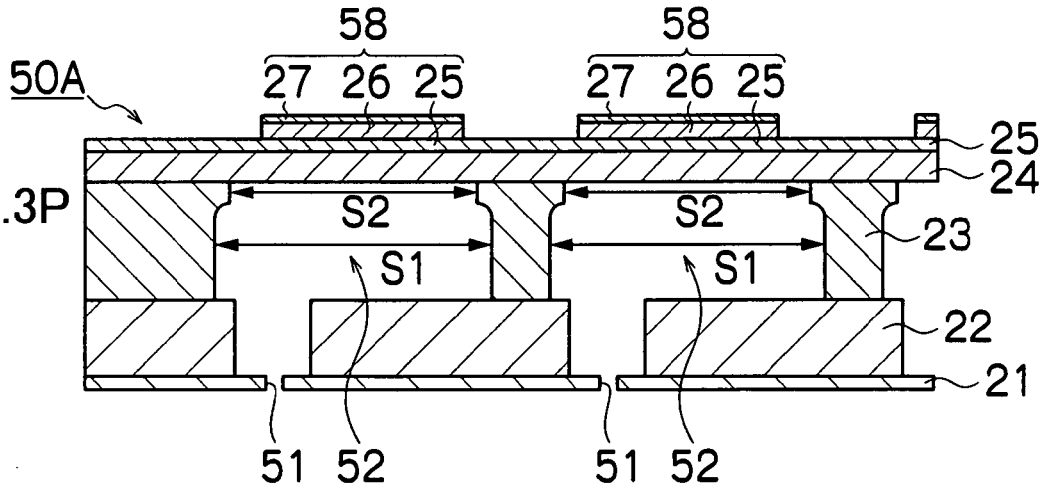

Thereupon, the nozzle connection plate 22 and the nozzle plate 21 formed with the nozzles 51, are bonded to the stainless steel substrate 23 as shown in FIG. 3P. Thus, the liquid ejection head 50A as shown in FIG. 2 is obtained.

Although the embodiment has been described in which the oxide film is deposited on the stainless steel substrate 23 to form the diaphragm 24, it is also possible to deposit a nitride film, instead of the oxide film, onto the stainless steel substrate 23 to form the diaphragm 24. Possible examples of the material of the nitride film include TiN, TiAlN, TiCrAlN, and SiCN.

The liquid ejection head 50A according to the first embodiment described above has the composition formed by: depositing the oxide film (or the nitride film) on the stainless steel substrate 23 as the diaphragm 24; forming the actuators 58, each of which includes the piezoelectric body 26 and the electrodes 25 and 27, on the side of the diaphragm 24 reverse to the side adjacent to the stainless steel substrate 23; and disposing the pressure chambers 52, each of which has the difference in width thereof, formed by etching the stainless steel substrate 23 in the plurality of steps, on the side of the stainless steel substrate 23 reverse to the side adjacent to the diaphragm 24.

By adopting this composition, even in a case where the diaphragm 24 is deposited as the thin film of 10 μm or less, and the stainless steel substrate 23 is etched from only one side (the pressure chamber 52 side), it is possible to improve the etching accuracy at the boundary between the stainless steel substrate 23 and the diaphragm 24 (in other words, the positional accuracy of the edges Eg of the ceilings of the pressure chambers 52). Hence, even in the case of the substrate is made from the stainless steel material, the ejection efficiency can be improved by means of the diaphragm 24 that is formed as the thin film, and variations in ejection between the nozzles 51 can be reduced.

The stainless steel material can be supplied in a rolled state, and compared to a case where a circular disk-shaped wafer made of silicon (silicon substrate) is prepared as the substrate material, it is possible to increase the number of liquid ejection heads that can be manufactured in one series of manufacturing steps described with reference to FIGS. 3A to 3P, and hence it is possible to mass produce liquid ejection heads with good efficiency, as well as being able significantly to reduce the related manufacturing costs.

Moreover, since the stainless steel material having the coefficient of linear expansion close to that of the piezoelectric bodies 26 is selected for the substrate material, then the occurrence of warping of the liquid ejection heads is prevented.

Further, by using the wet etching in the multiple-step etching process, it is possible to manufacture liquid ejection heads more inexpensively than in a case where dry etching is used.

Furthermore, since the diaphragm 24 is made of the diffusion inhibiting material, it is then possible to omit steps for forming a special diffusion inhibiting film, even when the material used for the substrate is the stainless steel, which contains iron and other elements that diffuse as impurities into the piezoelectric bodies 26 during annealing of the piezoelectric bodies 26, affect the perovskite crystalline structure of the piezoelectric bodies 26, and reduce the effectiveness of the displacement of the piezoelectric bodies 26 as a result.

Second Embodiment

Figure 4:
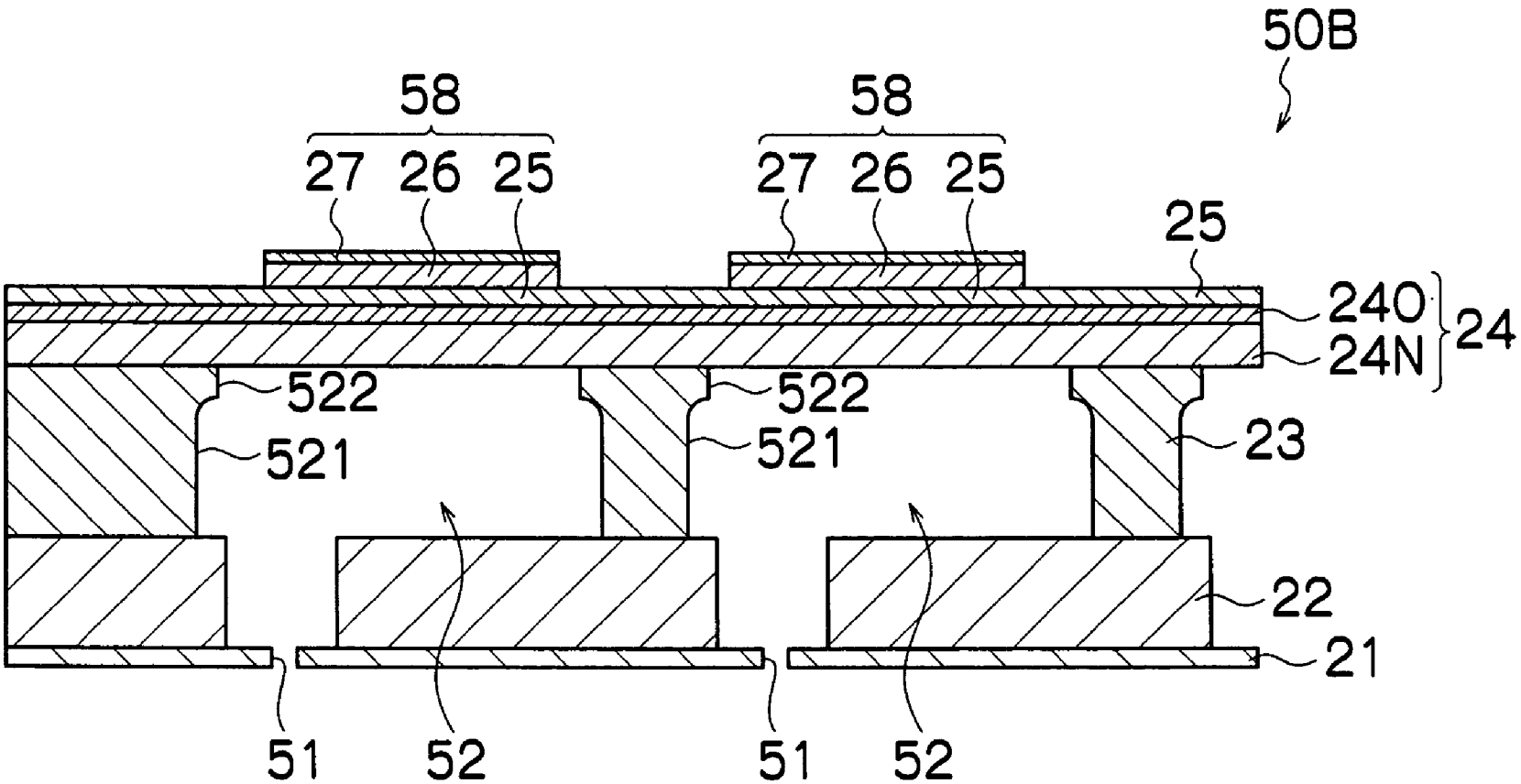
FIG. 4 is a cross-sectional diagram of a liquid ejection head according to a second embodiment of the present invention.

FIG. 4 is a cross-sectional diagram showing a liquid ejection head 50B according to a second embodiment of the present invention. In FIG. 4, constituent elements that are the same as those of the liquid ejection head 50A according to the first embodiment shown in FIG. 2 are denoted with the same reference numerals, and detailed description thereof already made is omitted below.

In FIG. 4, the diaphragm 24 includes a nitride film 24N made of TiN, TiAlN, TiCrAlN, SiCN, or the like, and an oxide film 24O, which is formed on the nitride film 24N by thermal oxidation processing of the nitride film 24N, in an oxygen atmosphere. More specifically, the oxide film 24O, which has the effect of preventing diffusion of iron, chromium, and the like, contained in the stainless steel substrate 23, into the piezoelectric bodies 26 during annealing of the piezoelectric bodies 26, is formed on the nitride film 24N.

The manufacturing process for the liquid ejection head 50B according to the second embodiment shown in FIG. 4 is now described with reference to FIGS. 5A to 5K.

Figure 5A:
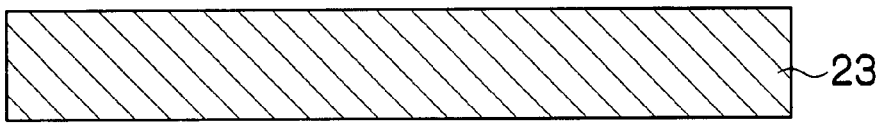
FIGS. 5A to 5K are processing step diagrams for explaining the manufacturing process for the liquid ejection head according to the second embodiment.

Firstly, the stainless steel substrate 23 is prepared as shown in FIG. 5A. In the present embodiment, the stainless steel material that has the coefficient of linear expansion close to that of PZT used as the material for the piezoelectric bodies 26, and also has heat resistance with respect to the subsequent heat treatment processes (firstly, the thermal oxidation process (pre-annealing) for forming the oxide film 24O, and secondly, the annealing process (main annealing) for calcining the piezoelectric bodies 26), is selected to be used as the substrate 23.

Specific examples of such the stainless steel material include: ferritic stainless steels, such as AISI430, AISI405 (X6Cr17, X6CrAl13), and the like; and martensitic stainless steels, such as AISI403, AISI410, AISI420 (X5Cr13, X10Cr13, X20Cr13), and the like.

The thickness of the stainless steel substrate 23 is, for example, 100 μm to 500 μm. If the plate material is thicker than the target thickness, then it is reduced in thickness by grinding (or by wet etching), so as to assume a thickness within the target range.

Figure 5B:
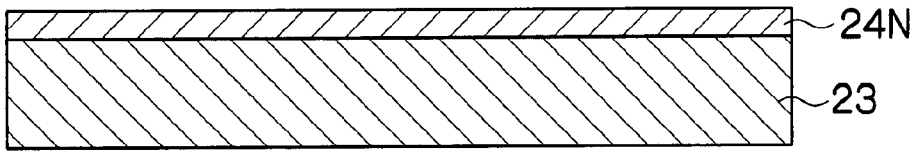

Next, the nitride film 24N is deposited onto the stainless steel substrate 23 as shown in FIG. 5B.

Examples of the thin film formation technique used to deposit the oxide film 24N include: physical vapor deposition (PVD) methods, such as ion plating and sputtering; and a chemical vapor deposition (CVD) method.

If the ion-plating method is used, then an evaporation material, such as titanium, is evaporated and ionized inside a prescribed chamber reduced to a high vacuum state, and the evaporation material is accelerated and made to impact against the stainless steel substrate 23 while introducing a suitable amount of nitrogen into the chamber as a reaction gas, thereby causing the nitride film 24N including nitrogen and the evaporation material having strong adhesiveness to the stainless steel substrate 23, to be deposited onto the stainless steel substrate 23. Here, the evaporation material used in the deposition of the nitride film 24N is not limited to titanium, and it is also possible to use aluminum, chromium, or the like.

The nitride film 24N is not limited to one that is deposited on only one face of the stainless steel substrate 23, and it is also possible to deposit the nitride films on both faces of the stainless steel substrate 23, in accordance with a film deposition method used.

Figure 5C:
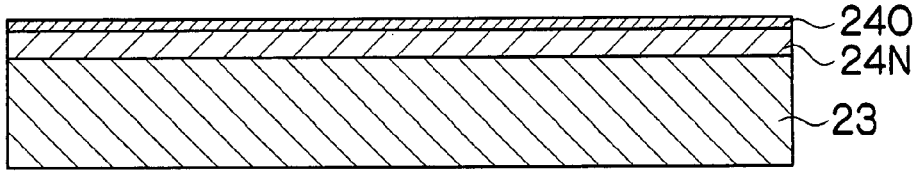

Next, the composition in the nitride film 24N is oxidized by means of the thermal oxidation process in an oxygen atmosphere, thereby forming the oxide film 24O on the nitride film 24N as shown in FIG. 5C. For example, if the evaporation material deposited on the stainless steel substrate 23 is titanium, then a $TiO_2$ film is formed. The oxide film 24O varies depending on the evaporation material used: if the evaporation material is aluminum, then an $Al_2O_3$ film is formed, and if the evaporation material is chromium, then a $Cr_2O_3$ film is formed.

Figure 5D:
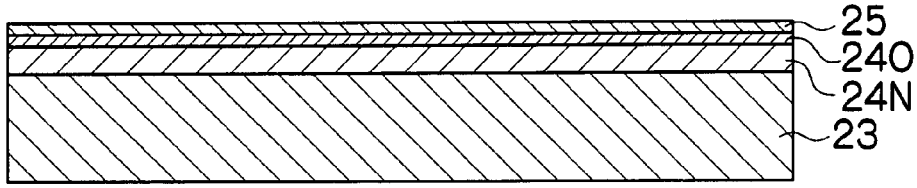
Figure 5E:
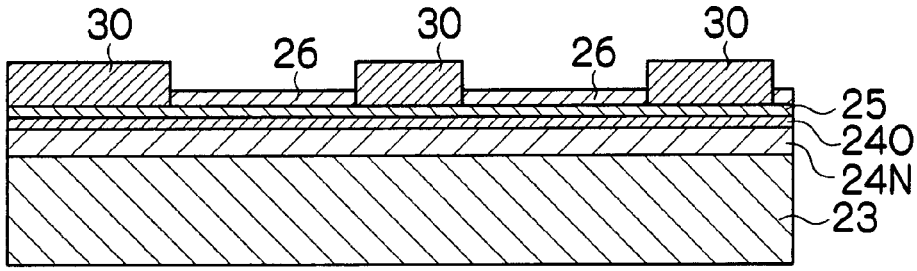
Figure 5F:
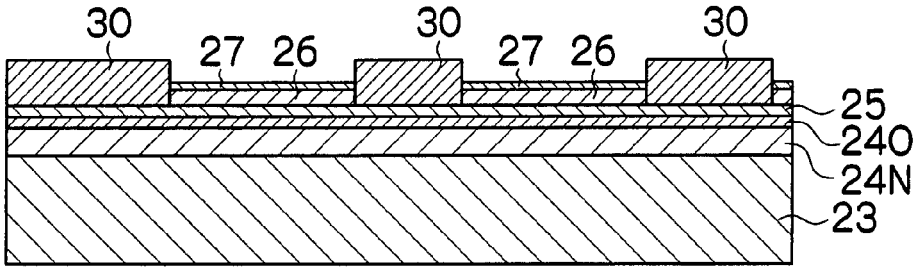
Figure 5G:
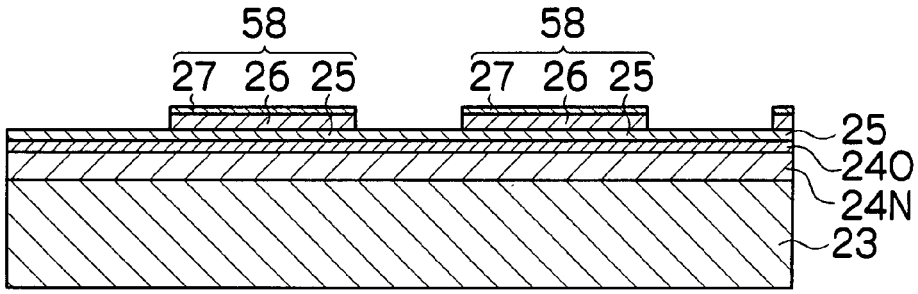

Next, a film made of Ti/Pt, Ti/Ir, Ti/Au, or the like, is deposited onto the oxide film 24O, to form the lower electrode 25, as shown in FIG. 5D. Thereupon, a resist 30 for forming the piezoelectric bodies 26 is applied onto the lower electrode 25, and films to form the piezoelectric bodies 26 are then selectively deposited as shown in FIG. 5E, by means of an aerosol deposition process at normal temperature. Then, films made of Ti/Pt, Ti/Ir, Ti/Pt/Au, or the like, are deposited onto the piezoelectric bodies 26 to form the upper electrodes 27, as shown in FIG. 5F.

Thereupon, the resist 30 for forming the piezoelectric bodies 26 is removed as shown in FIG. 5C, and then the stainless steel substrate 23 formed with the piezoelectric bodies 26 is subjected to annealing (heat treatment) at a temperature of 700° C. or above (for example, 800° C.).

Figure 5H:
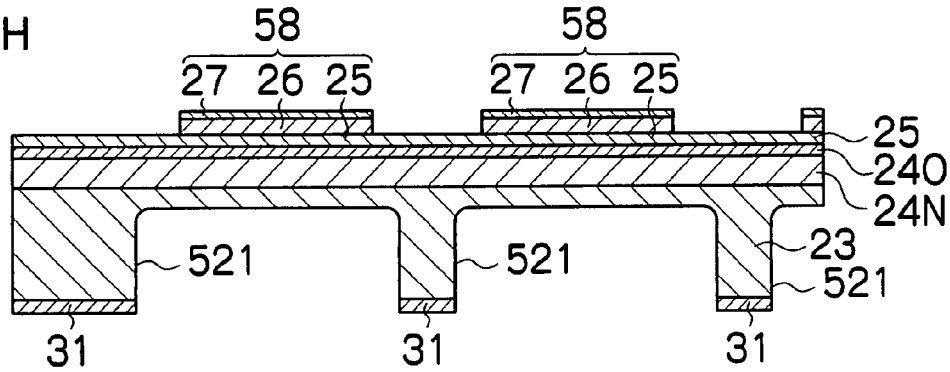
Figure 5I:
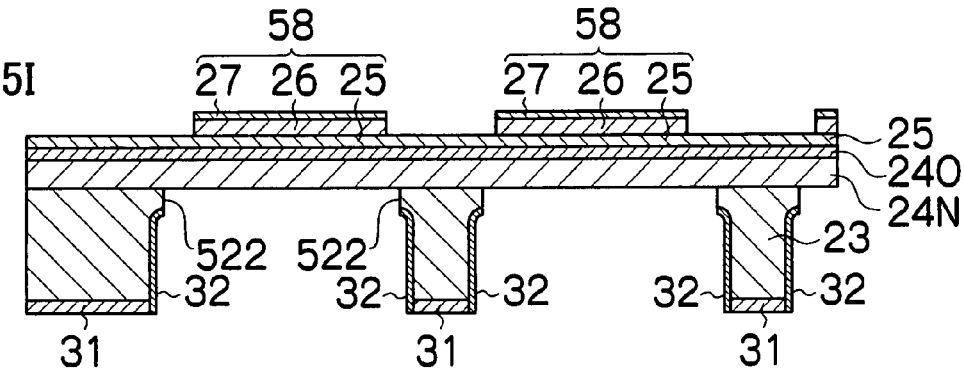
Figure 5J:
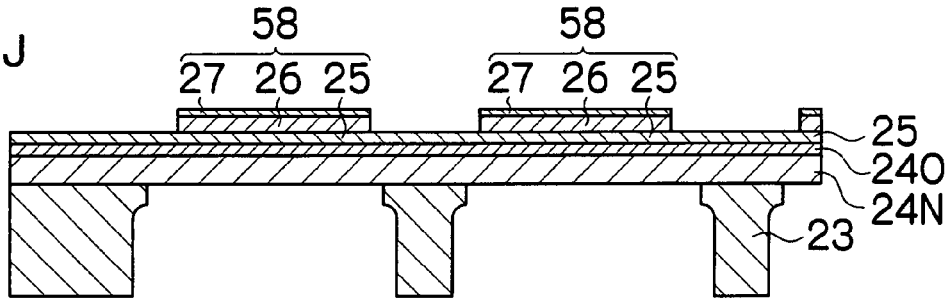
Figure 5K:
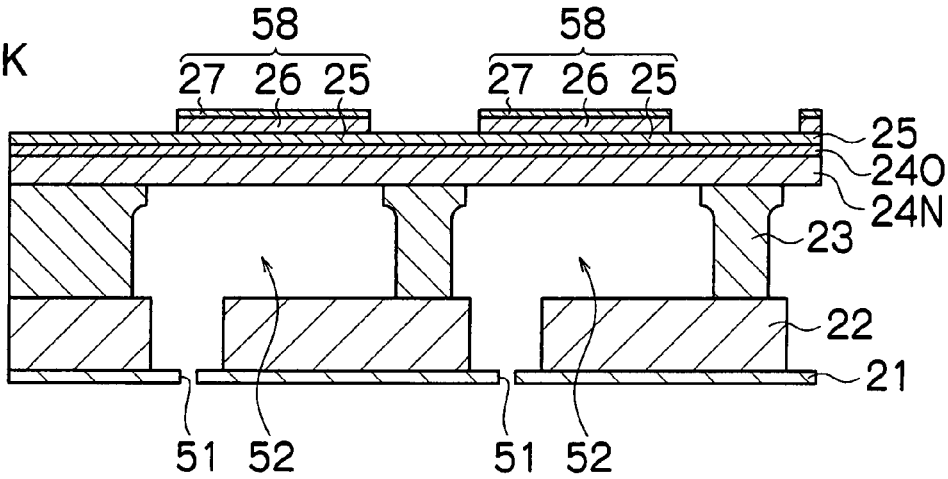

Subsequently, similarly to the first embodiment, as shown in FIGS. 5H to 5J, the pressure chambers 52, each of which has the difference in width thereof, are formed by etching the stainless steel substrate 23 in a plurality of steps, on the side of the stainless steel substrate 23 reverse to the side adjacent to the diaphragm 24. Then, the nozzle connection plate 22 and the nozzle plate 21 are bonded to the stainless steel substrate 23 as shown in FIG. 5K. Thus, the liquid ejection head 50B as shown in FIG. 4 is obtained.

The liquid ejection head 50B according to the second embodiment described above has the composition in which the oxide film 24O is formed on the nitride film 24N, by carrying out the thermal oxidation processing of the component contained in the nitride film 24N. Hence, there is higher degree of freedom in the selection of the material, compared to the case where the diaphragm 24 is formed only by means of the oxide film as described in the first embodiment.

For example, it is possible to select freely the material that bonds with nitrogen, from materials of various types, in accordance with the annealing temperature. For instance, if the annealing temperature is 800° C., then titanium or aluminum is selected, and if the annealing temperature is 1000° C., then chromium is selected. It is also possible to select the material that bonds with nitrogen, in accordance with the desired properties of the diaphragm.

Third Embodiment

Figure 6:
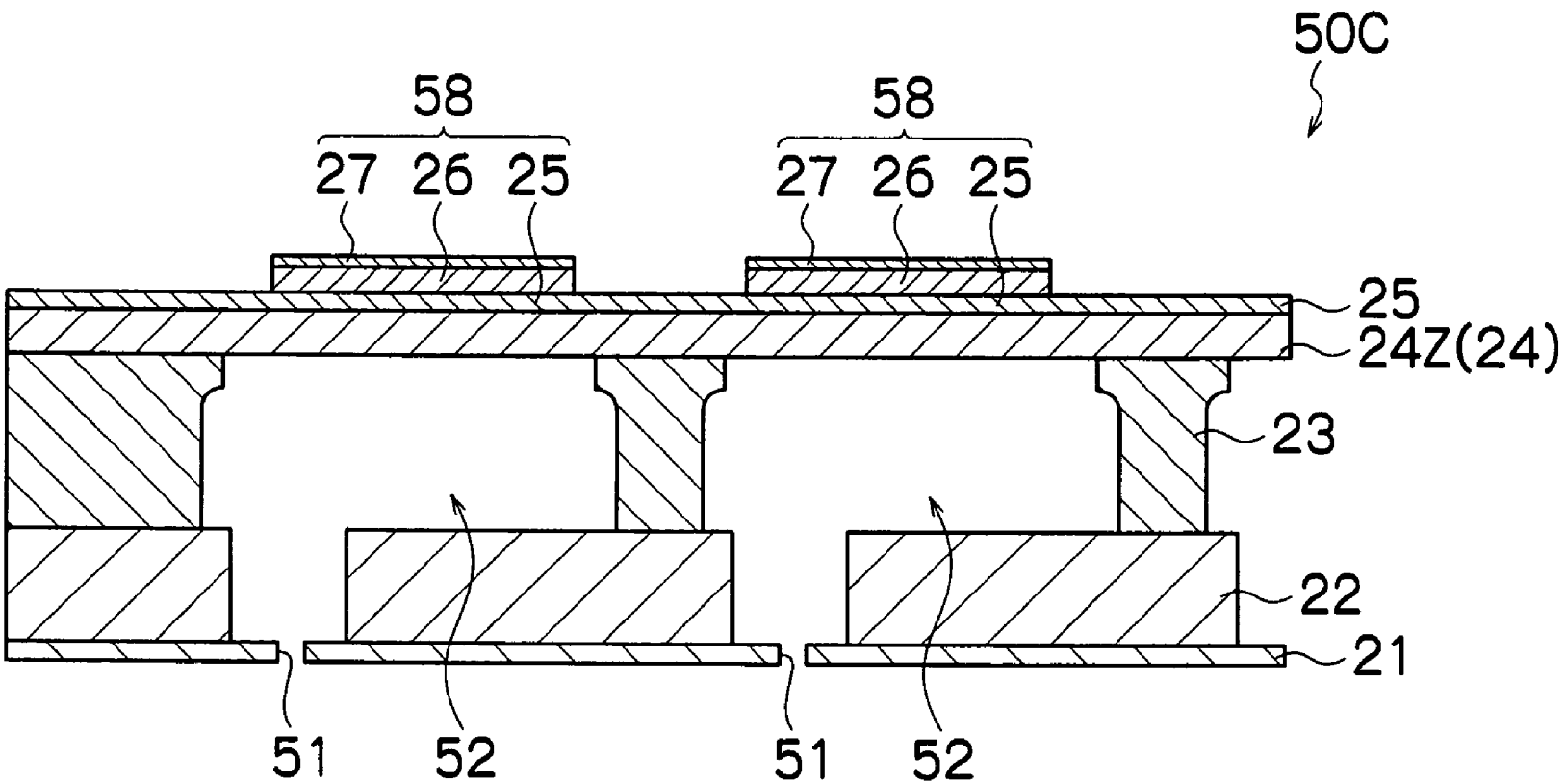
FIG. 6 is a cross-sectional diagram of a liquid ejection head according to a third embodiment of the present invention.

FIG. 6 is a cross-sectional diagram showing a liquid ejection head 50C according to a third embodiment of the present invention. In FIG. 6, constituent elements that are the same as those of the liquid ejection head 50A according to the first embodiment shown in FIG. 2 are denoted with the same reference numerals, and detailed description thereof already made is omitted below.

In FIG. 6, a diaphragm 24Z, which serves as the diaphragm 24, is made of the same material as the material of the piezoelectric bodies 26 constituting the actuators 58.

If the piezoelectric bodies 26 are made of the material containing lead zirconate titanate ($Pb(Zr,Ti)O_3$: PZT) as the main component, then it is also possible that the diaphragm 24Z is made of a material containing zirconia ($ZrO_2$) as the main component. More specifically, it is possible to use stabilized zirconia as the material of the diaphragm 24Z. Examples of the stabilized zirconia include: yttria ($Y_2O_3$) stabilized zirconia, calcia (CaO) stabilized zirconia, and magnesia (MgO) stabilized zirconia.

The manufacturing process for the liquid ejection head 50C according to the third embodiment is described now with reference to FIGS. 7A to 7D.

Figure 7A:
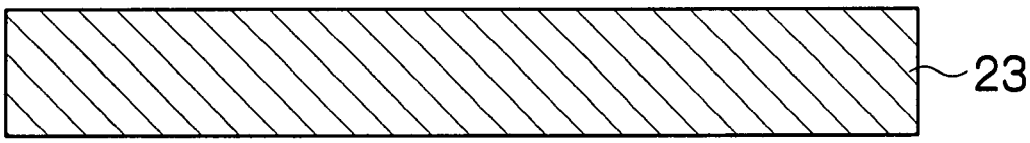
FIGS. 7A to 7D are processing step diagrams for explaining the manufacturing process for the liquid ejection head according to the third embodiment.
Figure 7B:
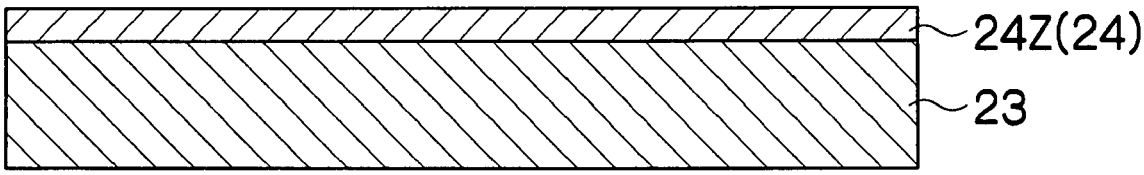

Firstly, the stainless steel substrate 23 is prepared as shown in FIG. 7A, whereupon, the diaphragm 24Z made of the same material as the piezoelectric bodies 26 is deposited onto the stainless steel substrate 23 by means of an aerosol deposition process, as shown in FIG. 7B.

Figure 7C:
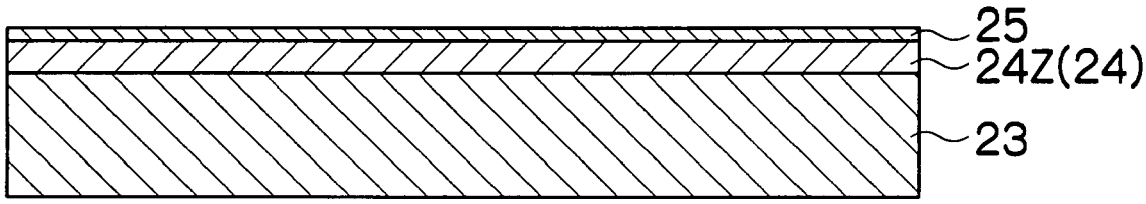
Figure 7D:
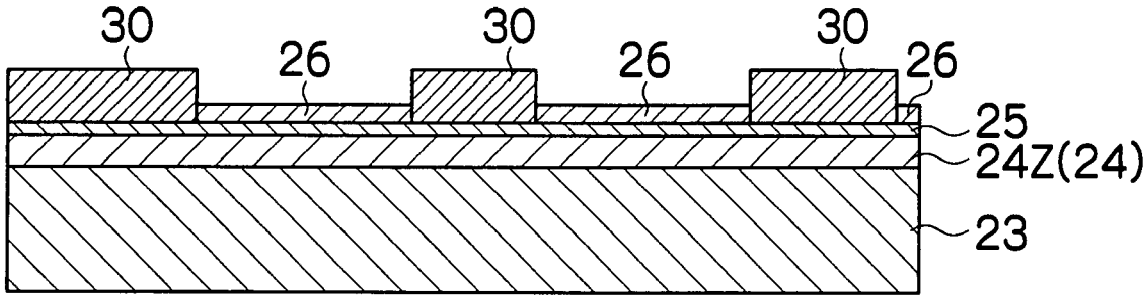

Thereupon, a film is deposited to form the lower electrode 25 on the diaphragm 24Z as shown in FIG. 7C. Then, a resist 30 for forming the piezoelectric bodies 26 is applied onto the lower electrode 25, and films to form the piezoelectric bodies 26 are selectively deposited as shown in FIG. 7D, by means of the aerosol deposition process.

In the third embodiment, in the deposition of the diaphragm 24 and the deposition of the piezoelectric bodies 26, it is possible to adopt a continuous process at a high film deposition rate, by using the same aerosol deposition process.

The subsequent steps are substantially the same as those of the first embodiment shown in FIGS. 3E to 3P. In other words, films are deposited to form the upper electrodes 27, the piezoelectric bodies 26 are annealed, the stainless steel substrate 23 is subjected to grinding if necessary, the pressure chambers 52, each of which has a difference in width thereof, are formed by wet etching the stainless steel substrate 23 in a plurality of steps, and the nozzle connection plate 22 and the nozzle plate 21 are bonded to the stainless steel substrate 23. The liquid ejection head 50C according to the third embodiment as shown in FIG. 6 is thus obtained.

Fourth Embodiment

Figure 8:
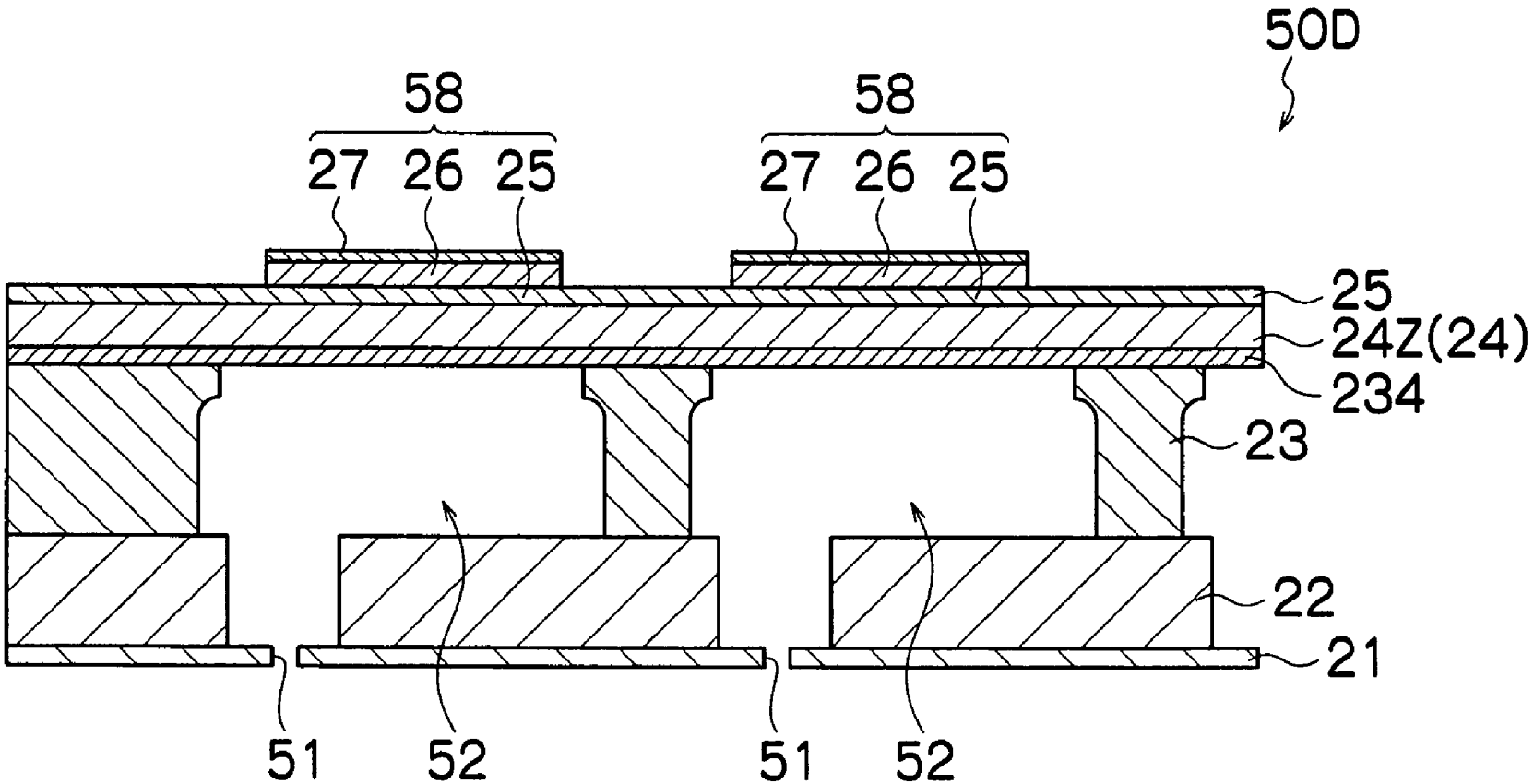
FIG. 8 is a cross-sectional diagram of a liquid ejection head according to a fourth embodiment of the present invention.

FIG. 8 is a cross-sectional diagram showing a liquid ejection head 50D according to a fourth embodiment of the present invention. In FIG. 8, constituent elements that are the same as those of the liquid ejection head 50C according to the third embodiment shown in FIG. 6 are denoted with the same reference numerals, and detailed description thereof already made is omitted below.

If the piezoelectric material constituting the diaphragm 24Z does not have resistance with respect to the etchant used in the final etching step of the pressure chambers 52, then as shown in FIG. 8, an etching stop layer 234 is formed between the stainless steel substrate 23 and the diaphragm 24Z.

Figure 9A:
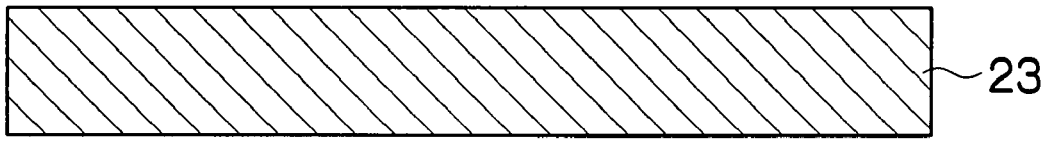
FIGS. 9A to 9C are processing step diagrams for explaining the manufacturing process for the liquid ejection head according to the fourth embodiment.
Figure 9B:
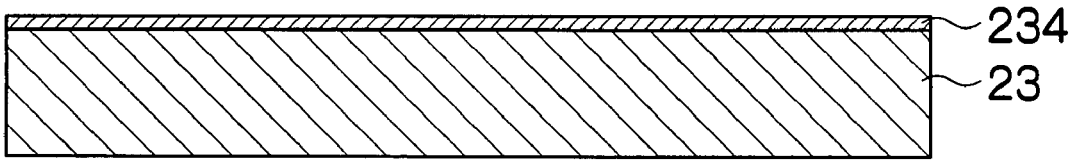
Figure 9C:
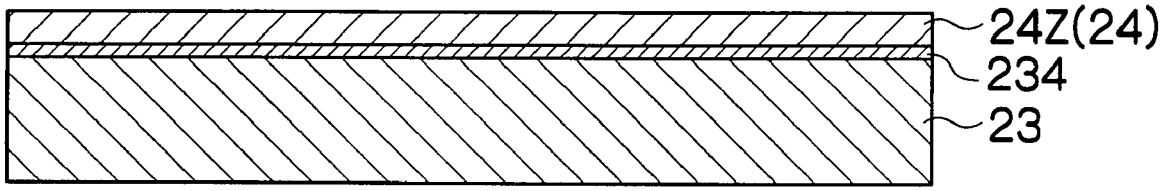

The manufacturing process for the liquid ejection head according to the fourth embodiment is described now with reference to FIGS. 9A to 9C.

Firstly, the stainless steel substrate 23 is prepared as shown in FIG. 9A, whereupon, a film is deposited to form the etching stop layer 234 containing titanium, or the like, onto the stainless steel substrate 23 as shown in FIG. 9B.

Here, the etching stop layer 234 has resistance with respect to the etchant of the final etching step for the pressure chambers 52.

Next, a film is deposited to form the diaphragm 24Z made of the same piezoelectric material as the piezoelectric bodies 26, onto the etching stop layer 234 as shown in FIG. 9C.

The subsequent processing steps are substantially the same as those of the third embodiment.

Beneficial effects are obtained if the final step (second step) of etching for the pressure chambers 52 uses a different etchant to the previous step (first step) of etching. By providing the etching stop layer 234 between the stainless steel substrate 23 and the diaphragm 24Z as described in the third embodiment, and by using the etchant for the final etching step of the pressure chambers 52 that is different to that used in the previous etching step, it is possible to improve the etching accuracy at the boundary between the stainless steel substrate 23 and the diaphragm 24, in other words, the positional accuracy of the edges of the ceiling of the pressure chambers 52.

Fifth Embodiment

Figure 10:
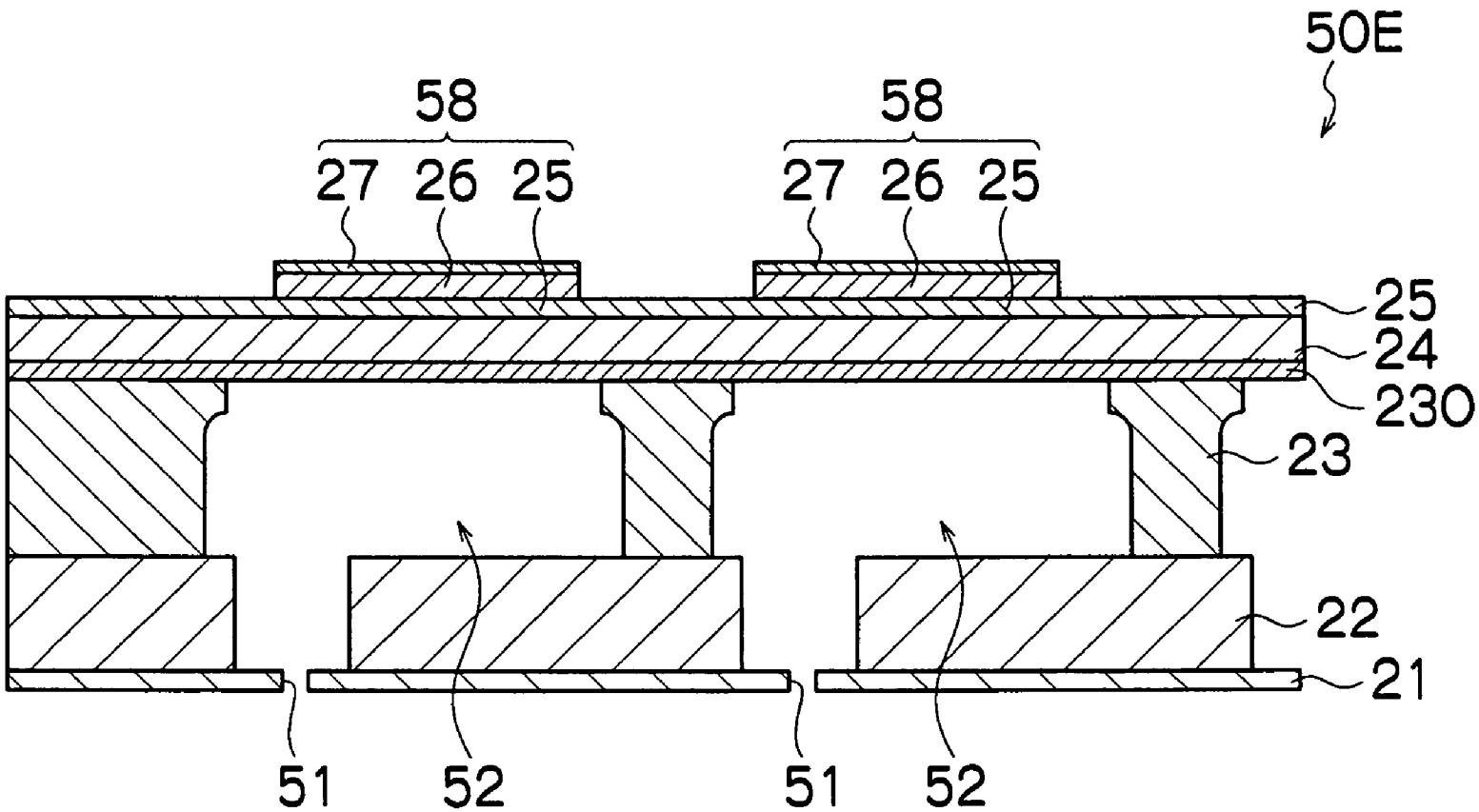
FIG. 10 is a cross-sectional diagram of a liquid ejection head according to a fifth embodiment of the present invention.

FIG. 10 is a cross-sectional diagram showing a liquid ejection head 50E according to a second embodiment of the present invention. In FIG. 10, constituent elements that are the same as those of the liquid ejection head 50A according to the first embodiment shown in FIG. 2 are denoted with the same reference numerals, and detailed description thereof already made is omitted below.

In FIG. 10, an oxide film 23O formed due to oxidation of the component contained in the stainless steel substrate 23 by means of an thermal oxidation process is formed on the surface of the heat-resistant stainless steel substrate 23 that makes contact with the diaphragm 24.

Here, the oxide film 23O made of $Cr_2O_3$ is formed if the heat-resistant stainless steel substrate 23 contains chromium. Furthermore, the oxide film 23O made of $Cr_2O_3$ and $Al_2O_3$ is formed if the heat-resistant stainless steel substrate 23 contains chromium and aluminum.

In the liquid ejection head 50E according to the fifth embodiment shown in FIG. 10, iron and other elements contained in the stainless steel substrate 23 are reliably prevented from diffusing into the piezoelectric bodies 26, by means of the oxide film 23O, which is formed by the thermal oxidation processing of the stainless steel substrate 23, and the diaphragm 24, which has the diffusion inhibiting properties as described above in the first embodiment; in other words, the diffusion is prevented by means of the double diffusion inhibiting film.

Figure 11A:
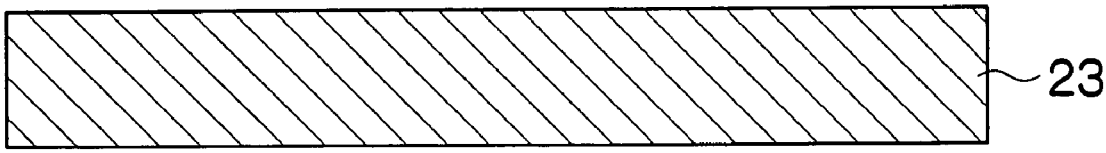
FIGS. 11A to 11C are processing step diagrams for explaining the manufacturing process for the liquid ejection head according to the fifth embodiment.
Figure 11B:
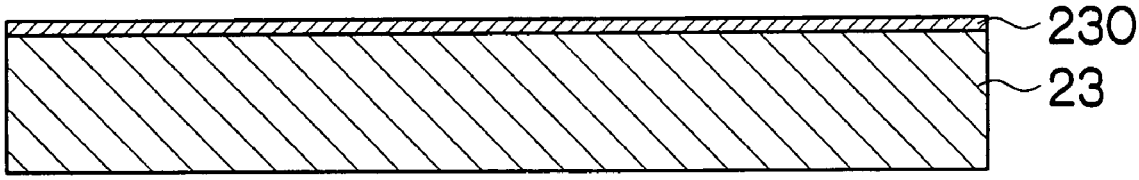
Figure 11C:
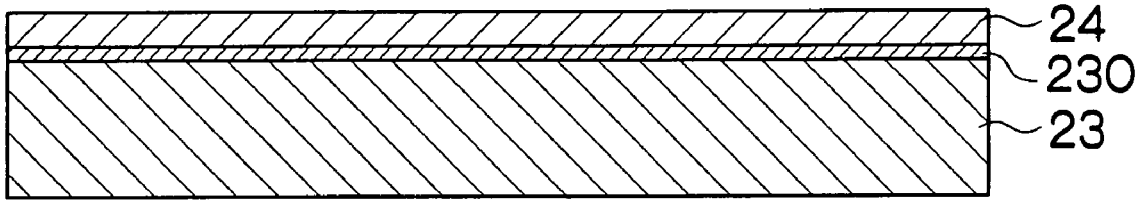

The manufacturing process for the liquid ejection head 50E according to the fifth embodiment is described now with reference to FIGS. 11A to 11C.

Firstly, the stainless steel substrate 23 is prepared as shown in FIG. 11A. Then, heat treatment is carried out onto the surface of the stainless steel substrate 23 on which the diaphragm 24 is to be formed, and the oxide film 23O is formed by oxidation of the component (chromium, aluminum, and the like) contained in the stainless steel substrate 23 as shown in FIG. 11B.

FIG. 11B shows the embodiment where the oxide film 23O is formed only on the upper surface of the stainless steel substrate 23, but it is also possible to form the oxide film 23O on the lower surface of the stainless steel substrate 23 too.

Thereupon, the diaphragm 24 is deposited onto the oxide film 23O as shown in FIG. 11C.

The subsequent processing steps are substantially the same as those of the first embodiment.

Here, the case is described in which the pressure chambers 52 are formed by the multiple-step wet etching after forming the oxide film 23O and annealing the piezoelectric bodies 26, but it is also possible to anneal the piezoelectric bodies 26 after forming the pressure chambers 52 by the multiple-step wet etching. In this case, it is possible to form the oxide film 23O on the openings of the pressure chambers 52, as well as the upper surface of the stainless steel substrate 23, and then to carry out annealing of the piezoelectric bodies 26 subsequently.

Embodiment of Composition of Image Forming Apparatus

Figure 12:
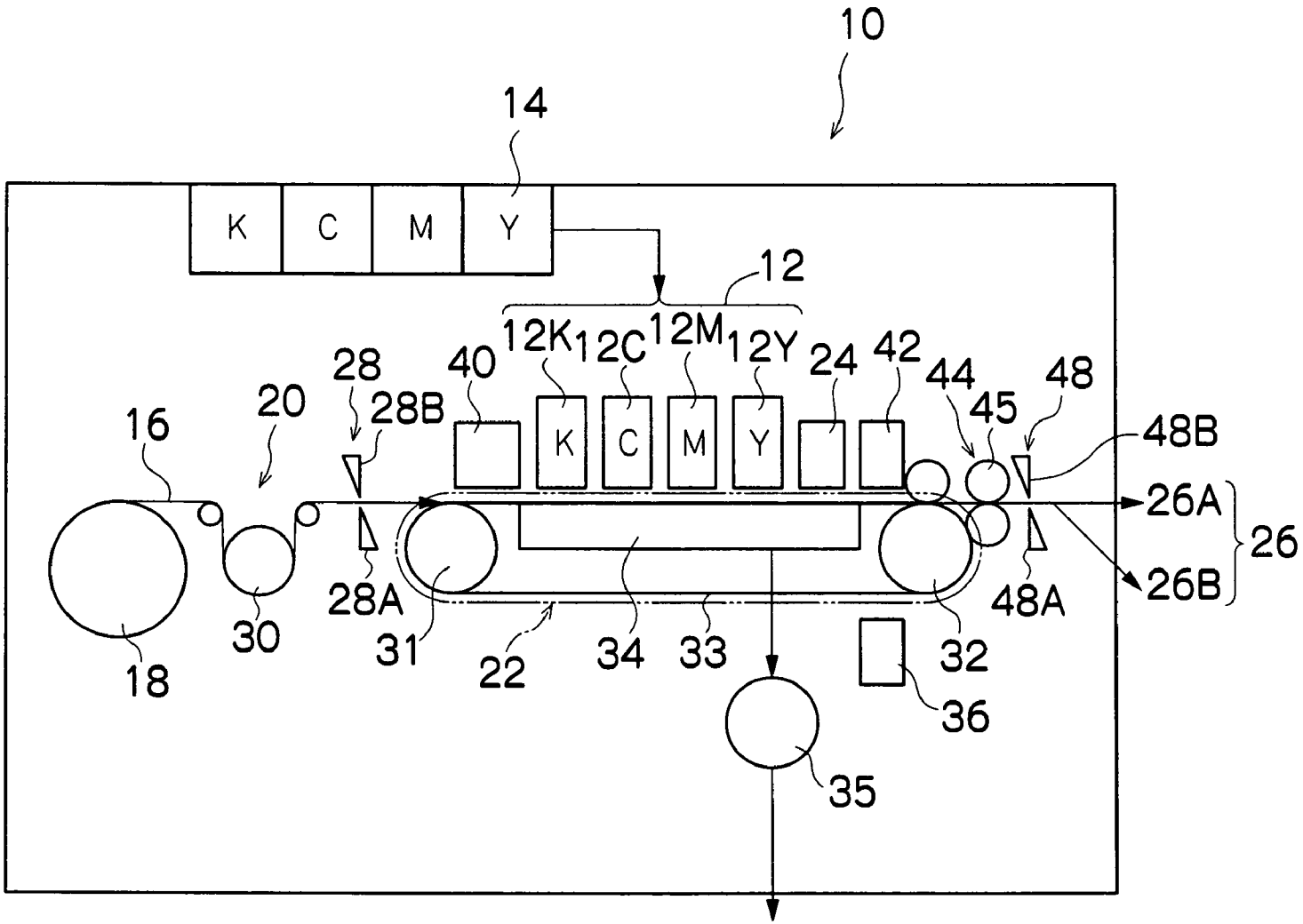
FIG. 12 is a general schematic drawing showing the overall composition of an image forming apparatus according to an embodiment of the present invention.

FIG. 12 is a general schematic drawing showing the mechanical composition of an image forming apparatus 10 according to an embodiment of the present invention. As shown in FIG. 12, this image forming apparatus 10 includes: an ejection unit 12 having a plurality of heads that are liquid ejection heads 50 as shown in FIG. 1 provided respectively for ink colors, namely, heads 12K (black ink head), 12C (cyan ink head), 12M (magenta ink head) and 12Y (yellow ink head); an ink storing and loading unit 14 which stores inks to be supplied to the respective heads 12K, 12C, 12M and 12Y; a paper supply unit 18 which supplies a medium 16, such as paper; a decurling unit 20, which removes curl from the medium 16; a suction belt conveyance unit 22, disposed facing the nozzle surfaces (droplet ejection surfaces) of the heads 12K, 12C, 12M and 12Y, which conveys the medium 16 while keeping the medium 16 flat; an image reading unit 24, which reads in an image produced by droplet ejection from the ejection unit 12; and a paper output unit 26, which outputs a printed medium (printed matter) to the exterior.

In FIG. 12, a magazine for rolled paper (continuous medium) is shown as an embodiment of the paper supply unit 18; however, more magazines with different medium width and quality may be jointly provided. Moreover, the medium may be supplied with cassettes that contain cut papers loaded in layers and that are used jointly or in lieu of the magazine for rolled paper.

In the case of a configuration in which a plurality of types of media can be used, it is preferable that an information recording medium such as a bar code and a wireless tag containing information about the type of medium 16 is attached to the magazine, and by reading the information contained in the information recording medium with a predetermined reading device, the type of medium to be used is automatically determined, and ink-droplet ejection is controlled so that the ink-droplets are ejected in an appropriate manner in accordance with the type of medium.

The medium 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the medium 16 has a curl in which the surface on which the print is to be made is slightly round outward.

In the case of the configuration in which roll paper is used, a cutter (first cutter) 28 is provided as shown in FIG. 12, and the continuous paper is cut into a desired size by the cutter 28. The cutter 28 has a stationary blade 28A, whose length is not less than the width of the conveyor pathway of the medium 16, and a round blade 28B, which moves along the stationary blade 28A. The stationary blade 28A is disposed on the reverse side of the printed surface of the medium 16, and the round blade 28B is disposed on the printed surface side of the medium 16 across the conveyor pathway. When cut papers are used, the cutter 28 is not required.

The decurled and cut medium 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the ejection unit 12 and the sensor face of the image reading unit 24 forms a horizontal plane (flat plane).

The belt 33 has a width that is greater than the width of the medium 16, and a plurality of suction apertures (not shown) are formed on the belt surface. A suction chamber 34 is disposed in a position facing the sensor surface of the image reading unit 24 and the nozzle surface of the ejection unit 12 on the interior side of the belt 33, which is set around the rollers 31 and 32, as shown in FIG. 12. The suction chamber 34 provides suction with a fan 35 to generate a negative pressure, and the recording paper 16 on the belt 33 is held by suction.

The belt 33 is driven in the clockwise direction in FIG. 12 by the motive force of a motor (not shown) being transmitted to at least one of the rollers 31 and 32, about which the belt 33 is set, and the medium 16 held on the belt 33 is conveyed from left to right in FIG. 12.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The image forming apparatus 10 can comprise a roller nip conveyance mechanism, instead of the suction belt conveyance unit 22. However, there is a drawback in the roller nip conveyance mechanism that the print tends to be smeared when the printing area is conveyed by the roller nip action because the nip roller makes contact with the printed surface of the medium immediately after printing. Therefore, the suction belt conveyance in which nothing comes into contact with the image surface in the printing area is preferable.

A heating fan 40 is disposed on the upstream side of the ejection unit 12 in the medium conveyance pathway formed by the suction belt conveyance unit 22. The heating fan 40 blows heated air onto the medium 16 to heat the medium 16 immediately before printing so that the ink deposited on the medium 16 dries more easily.

The ejection unit 12 is a so-called "full line head" in which a line head having a length corresponding to the maximum paper width is arranged in a direction that is perpendicular to the paper feed direction (medium conveyance direction) (see FIG. 1). Each of the heads 12K, 12C, 12M and 12Y is constituted by the full line head, in which a plurality of ink droplet ejection ports (nozzles) are arranged through a length that exceeds at least one side of the maximum-size medium 16 intended for use in the image forming apparatus 10, as shown in FIG. 1.

The heads 12K, 12C, 12M and 12Y are arranged in the order of black (K), cyan (C), magenta (M), and yellow (Y) from the upstream side, following the feed direction of the medium 16 (hereinafter, referred to as the medium conveyance direction). A color print can be formed on the medium 16 by ejecting droplets of the inks of respective colors from the heads 12K, 12C, 12M and 12Y while the medium 16 is conveyed.

The ejection unit 12, in which the full-line heads covering the entire width of the paper are thus provided for the respective ink colors, can record an image over the entire surface of the medium 16 by performing the action of moving the medium 16 and the ejection unit 12 relatively to each other in the medium conveyance direction just once (in other words, by means of a single scan in the medium conveyance direction). In this way, it is possible to achieve higher-speed printing and to improve productivity in comparison with a shuttle scanning type of head configuration, in which a head moves reciprocally in a direction that is substantially perpendicular to the medium conveyance direction.

Although the configuration with the KCMY four standard colors is described in the present embodiment, combinations of the ink colors and the number of colors are not limited to those. Light inks or dark inks can be added as required. For example, a configuration is possible in which heads for ejecting light-colored inks such as light cyan and light magenta are added.

As shown in FIG. 12, the ink storing and loading unit 14 has ink tanks for storing the inks of the colors corresponding to the respective heads 12K, 12C, 12M and 12Y, and the respective tanks are connected to the heads 12K, 12C, 12M and 12Y by means of channels (not shown). The ink storing and loading unit 14 has a warning device (for example, a display device, an alarm sound generator or the like) for warning when the remaining amount of any ink is low, and has a mechanism for preventing loading errors among the colors.

The image reading unit 24 reads in the droplet ejection results of the ejection unit 12, and the occurrence of nozzle blockages or other droplet ejection defects and droplet ejection variations is determined from the read image data obtained from the image reading unit 24.

The image reading unit 24 of the present embodiment is configured with at least a line sensor having rows of photoelectric transducing elements with a width that is greater than the ink-droplet ejection width (image forming width) of the heads 12K, 12C, 12M and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The image reading unit 24 according to the present embodiment reads in an image (which may be a test pattern or an actual image) that has been formed by the heads 12K, 12C, 12M and 12Y of the respective colors, and determines the droplet ejection variations for each head. Judgment of droplet ejection variations includes determining the presence or absence of ejected droplets (dots), and measuring the droplet ejection positions (dot positions), the ejected droplet diameters (dot diameters), the density, and the like. The image reading unit 24 is provided with a light source (not illustrated) which irradiates light onto the deposited dots.

A post-drying unit 42 is disposed following the image reading unit 24. The post-drying unit 42 is a device to dry the surface of the formed image, and includes a heating fan, for example. It is preferable to avoid contact with the printed surface until the ejected ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the image forming apparatus 10, a sorting device (not shown) is provided for switching the outputting pathways in order to sort the printed matter with the target print and the printed matter with the test print, and to send them to paper output units 26A and 26B, respectively. When the target print and the test pattern print are simultaneously formed in parallel on the same large medium, the test pattern print portion is cut and separated by a cutter (second cutter) 48. The cutter 48 is disposed directly in front of the paper output unit 26, and is used for cutting the test pattern print portion from the target print portion when a test pattern print has been performed in the blank portion of the target print. The structure of the cutter 48 is the same as the first cutter 28 described above, and has a stationary blade 48A and a round blade 48B.

Although not shown in FIG. 12, the paper output unit 26A for the target prints is provided with a sorter for collecting prints according to print orders. Incidentally 26B indicates a test print output unit.

The foregoing description related to the embodiment where the relative movement between the liquid ejection heads 50 formed with the nozzles 51 and the medium 16 is achieved by moving the medium 16 with respect to the fixed liquid ejection heads 50, but the present invention is not limited to cases of this kind, and the present invention can also be applied to a case where the medium 16 is fixed and the liquid ejection heads 50 are moved, or to a case where both the liquid ejection heads 50 and the medium 16 are moved.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a substrate made of a prescribed material on which a thin film is deposited to constitute a diaphragm;

a piezoelectric body which is formed on a face of the diaphragm opposite to a face adjacent to the substrate; and a pressure chamber which is formed in the substrate by etching the substrate in a plurality of etching steps from a side of the substrate opposite to a side adjacent to the diaphragm, wherein each etching step etches the substrate at a different width.

2. The liquid ejection head as defined in claim 1, wherein the material of the substrate is a stainless steel material containing iron as a main component.

3. The liquid ejection head as defined in claim 1, wherein the thin film constituting the diaphragm has a thickness of 1 μm to 10 μm.

4. The liquid ejection head as defined in claim 1, wherein the diaphragm and the piezoelectric body are made of a same material.

5. The liquid ejection head as defined in claim 1, wherein:

the piezoelectric body is made of a piezoelectric material containing lead zirconate titanate as a main component; and the diaphragm is made of a material containing zirconia as a main component.

6. The liquid ejection head as defined in claim 1, wherein an oxide film created by oxidation of a component in the substrate is formed on a surface of the substrate adjacent to the diaphragm.

7. An image forming apparatus, comprising:

the liquid ejection head as defined in claim 1, wherein the liquid ejection head ejects ink toward a prescribed medium to form an image on the medium.

8. The liquid ejection head as defined in claim 1, further comprising an etching stop layer which is formed between the substrate and the diaphragm, the etching stop layer having resistance with respect to an etchant used in the etching to form the pressure chamber.

9. The liquid ejection head as defined in claim 1, wherein:

the thin film constituting the diaphragm contains a nitride; and the liquid ejection head further comprises an oxide film which is formed between the diaphragm and the piezoelectric body by oxidizing the face of the diaphragm opposite to the face adjacent to the substrate.

10. A method of manufacturing a liquid ejection head, comprising:

a diaphragm forming step of depositing a thin film to form a diaphragm, on a substrate made of a prescribed material;

a piezoelectric body forming step of forming a piezoelectric body on a side of the diaphragm opposite to a side adjacent to the substrate; and a pressure chamber forming step of forming a pressure chamber by etching the substrate in a plurality of etching steps from a side of the substrate opposite to a side adjacent to the diaphragm, wherein each etching step etches the substrate at a different width.

11. The method as defined in claim 10, wherein:

the diaphragm and the piezoelectric body are made of a same material; and the diaphragm forming step and the piezoelectric body forming step employ an aerosol deposition process.

12. The method as defined in claim 10, wherein the etching in the pressure chamber forming step is wet etching.

13. The method as defined in claim 10, wherein a final step of the plurality of etching steps in the pressure chamber forming step uses an etchant that is different from another etchant used in a previous step of the plurality of etching steps.

14. The method as defined in claim 10, further comprising:

before the diaphragm forming step, an etching stop layer forming step of forming an etching stop layer on the substrate, the etching stop layer having resistance with respect to an etchant used in the etching in the pressure chamber forming step, wherein in the diaphragm forming step, the thin film to form the diaphragm is deposited on the etching stop layer on the substrate.

15. The method as defined in claim 10, wherein:

the thin film deposited in the diaphragm forming step contains a nitride;

the method further comprises, before the piezoelectric body forming step, an oxide film forming step of forming an oxide film on the side of the diaphragm opposite to the side adjacent to the substrate by oxidizing a surface of the diaphragm on the side of the diaphragm opposite to the side adjacent to the substrate; and in the piezoelectric body forming step, the piezoelectric body is formed on the oxide film on the diaphragm.

* * * * *